United States Patent [19]

Komori et al.

[11] 4,270,857

[45] * Jun. 2, 1981

[54] COPYING APPARATUS FOR SHEET ORIGINALS AND THICKER ORIGINALS

[75] Inventors: Shigehiro Komori; Hisashi Sakamaki, both of Yokohama; Hiroyuki Hattori, Mitaka, all of Japan; Toshihide Iida, late of Tokyo, Japan; Koichi Miyamoto, Tokyo; Kazumi Umezawa, Yokohama, both of Japan

[73] Assignee: Canon Kabushiki Kaisha, Tokyo, Japan

[ * ] Notice: The portion of the term of this patent subsequent to Apr. 16, 1991, has been disclaimed.

[21] Appl. No.: 893,825

[22] Filed: Apr. 5, 1978

Related U.S. Application Data

[60] Division of Ser. No. 860,457, Dec. 14, 1977, which is a continuation of Ser. No. 588,228, Jun. 19, 1975, abandoned, which is a division of Ser. No. 583,247, Jun. 3, 1975, Pat. No. 4,009,955, which is a continuation of Ser. No. 461,104, Apr. 15, 1974, abandoned, which is a continuation of Ser. No. 258,820, Jun. 1, 1972, Pat. No. 3,804,512.

[30] Foreign Application Priority Data

| | | | |
|---|---|---|---|
| Jun. 3, 1971 | [JP] | Japan | 46-38917 |
| Jun. 3, 1971 | [JP] | Japan | 46-38918 |
| Jun. 9, 1971 | [JP] | Japan | 46-48632 |
| Jun. 10, 1971 | [JP] | Japan | 46-41195 |
| Jun. 10, 1971 | [JP] | Japan | 46-41197 |
| Jun. 10, 1971 | [JP] | Japan | 46-41198 |
| Jun. 21, 1971 | [JP] | Japan | 46-44611 |
| Aug. 30, 1971 | [JP] | Japan | 46-66740 |

[51] Int. Cl.[3] ..... G03G 15/28; G03G 15/30

[52] U.S. Cl. ..... 355/8; 355/14 R

[58] Field of Search ..... 355/3 R, 8, 14

[56] References Cited

U.S. PATENT DOCUMENTS

| | | | |
|---|---|---|---|
| Re. 29,186 | 4/1977 | Komori et al. | 355/8 |
| 3,510,218 | 5/1970 | Limberger et al. | 355/8 UX |
| 3,560,087 | 2/1971 | Washio et al. | 355/8 X |
| 3,594,079 | 7/1971 | Murgas et al. | 355/8 |
| 3,740,132 | 6/1973 | Komori et al. | 355/8 X |
| 3,804,512 | 4/1974 | Komori et al. | 355/8 X |

*Primary Examiner*—Fred L. Braun

*Attorney, Agent, or Firm*—Fitzpatrick, Cella, Harper & Scinto

[57] ABSTRACT

In a copying device for selectively copying sheet originals and thicker originals, the thicker originals being copied while positioned on a reciprocating original carriage. In one mode of copying thick originals, the original carriage is reciprocated one time for each rotation of the photosensitive drum while in another mode each reciprocation corresponds to two rotations of the drum. In one mode of copying sheet originals the photosensitive drum rotates once for each copy while in another mode a plurality of copies are formed for each rotation. The copying device has a control system for detecting the position of the reciprocating carriage and for controlling the forward and reverse movement of the carriage as a function of the size of the original being copied as well as the position of the carriage.

25 Claims, 25 Drawing Figures

Y
X
115
1354
1281
1352
1351
1282
135'
139
74
1353
128
138
135
129
130
72
SL1
132
123
1231
121
126
122
131
1291

COPYING APPARATUS FOR SHEET ORIGINALS AND THICKER ORIGINALS

This application is a division of application Ser. No. 860,457, filed Dec. 4, 1977, which in turn is a continuation of Ser. No. 588,228, filed June 19, 1975, now abandoned, which in turn is a division of Ser. No. 583,247, filed June 3, 1975, now U.S. Pat. No. 4,009,955, which in turn is a continuation of Ser. No. 461,104, filed Apr. 15, 1974, now abandoned, which in turn is a continuation of Ser. No. 258,820, filed Jun. 1, 1972, now U.S. Pat. No. 3,804,512.

BACKGROUND OF THE INVENTION

1. Field of the Invention

This invention relates to a copying appartus for copying both sheet originals and thicker originals, and more particularly to an epoch-making copying apparatus which is capable of high-speed copy production and which incorporates various novel process means.

2. Description of the Prior Art

The conventional copying machines are generally classified into two types, one of which is only able to copy sheet originals and the other is meant to copy three-dimensional originals such as books and the like.

The copiers exclusively for use with sheet originals cannot copy books or other thicker originals but are meritorious is that sheet originals can be rapidly copied simply be feeding them into an inlet for insertion and that there is no return stroke for the original carriage or the optical system during the same process, thus enhancing the copying speed correspondingly or approximately twice. These copiers have further merits in the simplicity and low cost of the entire construction, and also in the readiness with which an automatic original supply means may be added if required.

The other type of copiers, i.e. those for copying books or thicker originals have a great characteristic that they can copy both sheet originals and thicker originals. However, their construction is such that any original to be copied must be flatly spread over the original carriage, and such constructions unavoidably leads to cumbersome procedures of raising the original keep cover to place each sheet original on the original carriage, closing the keep cover and depressing the copy button, as is required to copy thicker originals. Moreover, the original carriage or the optical system operatively involves its return stroke, which means a corresponding loss of time and accordingly a corresponding reduction in copying speed for the same process. Additionally, mechanisms are not only complicated and expensive but also great difficulties will be encountered in incorporating an automatic original supply means.

For these reasons, the foregoing two conventional types of copying machines hve been enjoying their unique markets, respectively.

In most offices, however, demand for copies of sheet originals is greater than that for copies of thicker originals. For this reason, those offices had to resort to copying machines for thick originals which are more expensive and less convenient to copy sheet originals.

To overcome such irrationality, there have heretofore been proposed copying apparatuses which are capable of copying thicker originals while maintaining their merits as sheet original copying apparatus. Such apparatus are grouped into the following two types:

I. The apparatus portion overlying the path of sheet originals is detachably constructed so that when copying thicker originals, such portion may be detached from the apparatus body so as to expose the sheet original transport rolls of the apparatus body. A thicker original may be manually urged against such exposed transport rolls and transported with the aid of the rubber rolls so as to be subjected to a through-slit exposure.

II. This type is substantially identical in construction with the type I except that there is additionally provided a carrier comprising a transparent plate of glass or plastics, on which a thicker original may be placed and transported for exposure with the edges of the carrier held by two or more pairs of transport rolls.

These two types of apparatus are substantially similar to the sheet original copying machines in construction and accordingly in cost, but suffer from some demerits as follows:

(1) From the use's point of view, removal of an apparatus portion means a considerably cumbersome procedure, and also would encounter a difficulty in providing a storage space therefor if the entire office space is limited. In case of type II, storage of the carrier would also be troublesome.

(2) In case of type I, the variable manual pressure imparted to the original may cause a great variation in the load to the drive of the apparatus body. In case of type II, the thickness of the carrier may cause a corresponding variation in the length of the optical path, which in turn would result in erroneous focusing and accordingly erroneous synchronization, thus seriously affecting the quality of the resultant copies.

(3) A gear sprocket wheel located at the end of original transport rolls for driving such rolls, and further in case of type II, carrier transport rolls, would project outwardly of the path for originals, thus preventing such path from being flat and accordingly preventing a portion of a bulky original from being copied.

(4) Where the original to be copied has a substantial thickness like books and the leading edge of the original (as viewed in the direction of movement thereof) has a complicated configuration (due to the book cover or the opened position of the book with the page margins thereof forming a slope), the position for the leading edge of the resultant copy image may be greatly variable because the leading edge of the book or like original is detected by a detector switch designed for detecting the leading edges of sheet originals.

Thus, the copying apparatus of the types as mentioned under items I and II above are practically unsatisfactory and even their merits are merely nominal.

SUMMARY OF THE INVENTION

The present invention eliminates all the disadvantages mentioned above, and includes improvements in the various components of a copying apparatus.

An object of the present invention is to provide a copying apparatus which can fully function both as sheet original copier and thick original copier and also can increase the copying speed in accordance with the variable size of copies.

The copying apparatus of the present invention is of the type using the liquid development and image transfer system and is of such construction that sheet originals and thicker originals such as books and the like may equally be copied with ease.

Where sheet originals are to be copied by the copying apparatus of the present invention, a sheet original is inserted into the nip between sheet original transport rolls rotating in synchronizm with a photosensitive drum normally rotated after a predetermined time of start preparation has passed, as will further be described. The leading edge of the sheet original is detected by detector means including a lamp and light receiving element, whereupon the transport rolls are temporarily stopped, thus stopping the original sheet. When the rotating photosensitive drum comes to a predetermined position, an original start signal is produced from the photosensitive drum to rotate the transport rolls again, so that the original is transported in synchronism with the photosensitive drum and finally discharged out of the apparatus by transport means such as rolls. During such travel, the original passes through as illuminating station. The photosensitive drum is normally rotating in one direction. The photosensitive drum passes through suitable copying processes to form a latent image thereon and reaches a developing means, which comprises a developing liquid tank, means such as pump or the like for stirring and raising developing liquid, and a developing electrode. This electrode is adapted to be urged toward the photosensitive drum by spring means with a very slight clearance maintained therebetween. The latent image formed on the photosensitive drum is developed into a visual image by toner contained in the developing liquid raised onto the developing electrode by said pump or like means. The excess developing liquid left on the photosensitive drum is removed by a post charger without disturbing the formed image. Subsequently, a transfer medium fed from paper feed means is brought into intimate contact with the surface of the photosensitive drum so that the image on the drum is transferred to the transfer medium as the latter is electrically charged. Thereafter, the transfer medium is separated from the photosensitive drum by a separator belt and directed to a drying-fixing station. Any residual developing liquid with toner remaining on the photosensitive drum is wiped off by the edge portion of a blade cleaner urged into contact with the photosensitive drum, thus making the drum ready for reuse in the next cycle. The developing liquid thus wiped off by the blade cleaner flow along grooves formed around the opposite end portions of the photosensitive drum and down into the developing means for reuse.

Where book or thicker originals (hereinafter referred to as "book originals") are to be copied, the copying apparatus is changed over from the above-described sheet original copying mode to a book original copying mode. Such mode change-over may be accomplished by depressing a change-over button to cause means such as lever and projection to release a cam on the underside of the original carriage from its sheet original copying position, thus displacing the original carriage into its book original copying position. With such movement of the original carriage from its sheet original copying position into its book original copying position, the drive and electric supply to the sheet original transport means is cut off to thereby change over the circuit into a mode for book originals. In the book original copying mode, the leading edge of a book original assumes the position which was previously occupied by the detector means in the sheet original copying mode. A book original to be copied is placed on the original carriage with the leading edges of the original and carriage registered with each other, whereafter the original is covered with an original keep cover and the copy button is depressed. As described with respect to the sheet original copying mode, a start signal is produced from the photosensitive drum to energize means such as electromagnetic plunger, thus starting to drive the original carriage reciprocally. A through-slit exposure takes place in synchronism with the peripheral speed of the photosensitive drum. After the exposure, the original carriage reverts to its return stroke in response to a signal produced from itself in accordance with the size of the original. The speed for the return stroke is higher than the speed for the forward stroke to enhance the copying speed. If multiple copies of the same book original are to be obtained continuously, the copy button is maintained depressed until a preset number of copies has been counted up by counter means for counting such number, thus providing any desired number of copies. In the other points, the operation in the book original copying mode is identical with that in the sheet original copying mode.

The start preparation preceding to the ordinary copying operation and the rest position and re-start succeeding to the completion of the copying operation will now be described briefly.

In the copying apparatus of the present invention which utilizes the liquid development system, a very small amount of toner usually tends to build up in the neighborhood of the edge portion of the blade cleaner used to clean the photosensitive drum so as to remove the residual developing liquid with toner after the image transfer. If the apparatus is stopped and left under such condition for many hours, the carrier collected at the edge portion would evaporate to solidify the toner. If the apparatus is re-started to rotate the drum under such condition, the solidified toner would injure the edge of the cleaner and/or the surface of the photosensitive drum or might adversely affect the formed image on the drum surface. For these reasons, the copying apparatus of the present invention is arranged so that closing of the main switch does not result in rotation of the drum but only allows rotation of the pump in the developing means to stir and introduce the developing liquid upwardly into a liquid supply pipe so as to pour onto the blade cleaner. After the solidified toner at and near the cleaner's edge portion is fluidized in a predetermined time, the photosensitive drum begins to rotate and the fluidized toner is wiped off.

On the other hand, if the power source should be left connected even after completion of the copying cycles, the photosensitive drum will continue its rotation and this is undesirable in respect of the service life of the drum and/or the blade cleaner. To avoid this, the copying apparatus of the present invention is also arranged so that when no further copying cycle is wanted after a previous one, the drum may be automatically stopped into a rest position irrespective of the closed position of the main switch. In such rest position, depression of the re-start switch in the operating portion will return all the apparatus parts to the position which was taken before the rest position.

BRIEF DESCRIPTION OF THE DRAWINGS

The invention will become fully apparent from the following detailed description of various embodiments thereof taken in conjunction with the accompanying drawings, in which.

DESCRIPTION OF THE PREFERRED EMBODIMENTS

The copying apparatus of the present invention is of the liquid development and transfer type which can selectively copy sheet originals such as documents and the like or thicker originals such as books and the like, as described.

Figure 1:
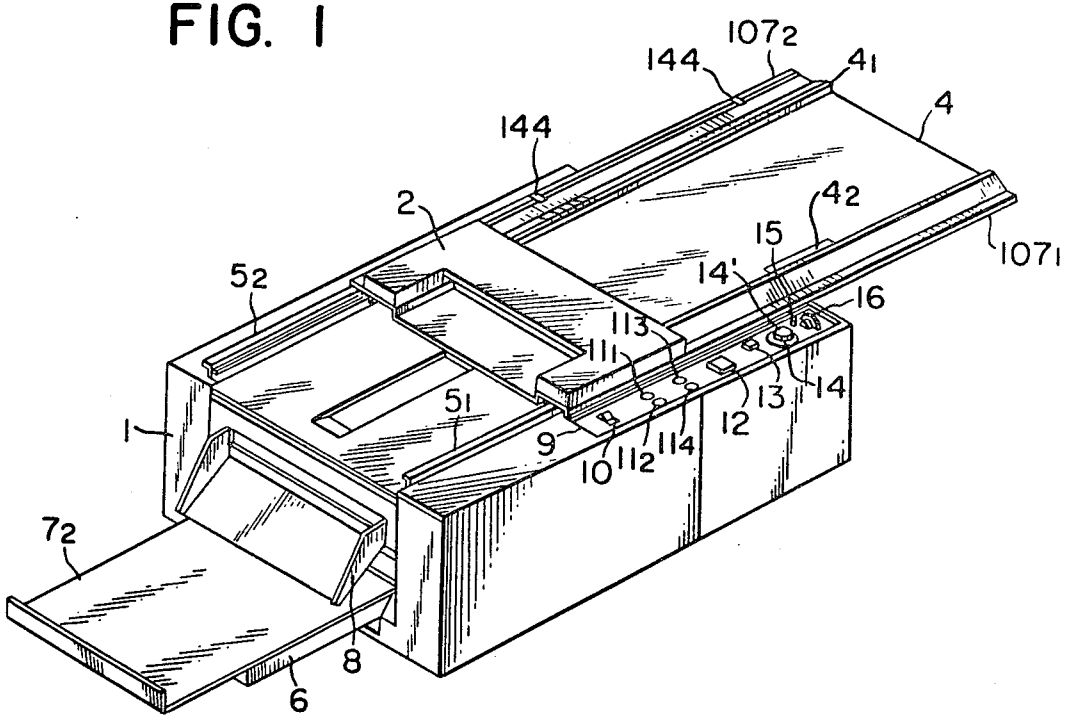
FIG. 1 is a perspective view showing an embodiment of the copying apparatus according to the present invention.

Referring to FIG. 1, an embodiment of the copying apparatus according to the present invention includes a housing 1, a sheet original transport means 2, and an original carriage 3 for supporting thereon a thick original (hereinafter referred to as "book original") and covered with an original keep cover 4. The apparatus further includes a pair of guide rails $5_1$ and $5_2$ for the original carriage, a cassette 6 containing therein a stock of transfer paper sheets P, and a lid 7 for the cassette which may also serve as a tray for receiving transfer paper sheets discharged out of the apparatus after image transfer. There are further seen an auxiliary tray 8, an operating portion 9 including a main switch 10, a group of alarm lamps $11_1$–$11_4$, a re-start lamp switch 12 which is to be further described, a button 13 for changing ovr the mode of operation between a mode for copying sheet originals and a mode for copying book originals, a knob and copy button 14 for selecting a mode for continuously producing multiple copies of a book original, a button 15 for urgently stopping the continuous copy mode for a book original, and a dial 16 for adjusting the density of desired copies.

Figure 2:
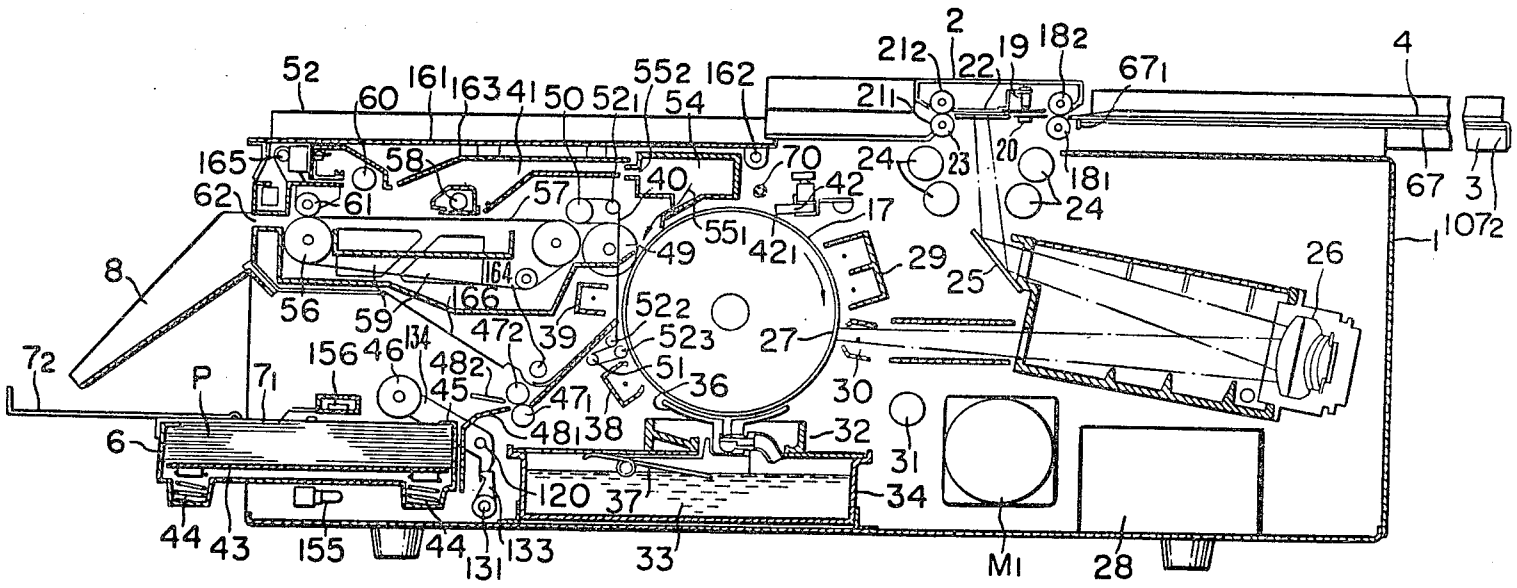
FIG. 2 is a longitudinal section thereof.

With reference to FIG. 2, the operation of such copying apparatus will first be described as to the case where sheet originals are to be copied. A sheet original is inserted from the right of the apparatus into the nip between the rolls $18_1$ and $18_2$ of the sheet original transport means 2 which are rotated in synchronism with a photosensitive drum 17 which is normally rotated after a certain time for start preparation as will be described later, and then the inserted sheet original is transported leftwardly. As soon as the leading edge of the sheet original is detected by a lamp 19 and a light receiving element 20, the rolls $18_1$ and $18_2$ are temporarily stopped from rotating, and thus the original is also stopped. Subsequently, when the photosensitive drum 17 comes to a predetermined position, a start signal for the original is produced to rotate the rolls $18_1$ and $18_2$ again so that the original is further transported leftwardly in synchronism with the rotation of the photosensitive drum 17, whereafter it is discharged upwardly by rolls $21_1$ and $21_2$. During that while, the original is illuminated from therebelow at an illuminating station 22 by four lamps 24 as it is moved on a glass plate. The image of the original is optically directed by a mirror 25 and a mirror lens 26 through an exposure station 27 to the surface of the photosensitive drums 17, thus forming an image thereon.

The photosensitive drum 17 comprises a photosensitive layer covered wih a transparent dielectric layer and is normally rotated in clockwise direction as viewed in FIG. 2. The photosensitive drum 17 is first charged with positive polarity by a primary charger 29 supplied with a high voltage of positive polarity from a high voltage source 28. When the charged surface portion of the photosensitive drum 17 comes to the exposure station 27, the image from the illuminating station is projected on such portion of the drum 17 through a slit while it is discharged by an AC discharger 30 supplied with a high AC voltage from the high voltage source 28. Then that surface portion of the photosensitive drum 17 is subjected to an overall exposure by a lamp 31, thus forming an electrostatic latent image on the surface portion thereof, whereafter the image carrying surface portion of the photosensitive drum 17 enters a developing means 32. The developing means 32 comprises a container 34 for containing a body of developing liquid 33, a pump 35 (FIG. 5) for stirring and raising the developing liquid, and an electrode 36 normally biased toward the photosensitive drum by a spring 37 so as to maintain a slight clearance with respect to the drum surface. The electrostatic latent image formed on the photosensitive drum 17 is developed into a visible image with the aid of toner particles contained in the developing liquid and raised onto the electrode 36 by the pump 35.

Subsequently, at a post charger 38, the image carrying surface portion of the photosensitive drum 17 is charged with a negative high voltage from the high voltage source to remove the excess liquid from the surface of the photosensitive drum 17 without disturbing the developed image thereon. Thereafter, a sheet of transfer paper P is fed from a paper feed station and brought into intimate contact with the image carrying surface of the photosensitive drum 17 so that the image on the photosensitive drum 17 is transferred onto the sheet of transfer paper P with the aid of a positive high voltage applied thereto at a transfer charger 39 from the voltage source 28. After the image transfer, the transfer paper P is separated from the photosensitive drum 17 by a separator belt 40, and then directed to a drying-fixing station 41. The photosensitive drum 17 is cleaned by the edge portion $42_1$ of a blade cleaner 42 urged into contact with the drum 17 to remove any residual amount of liquid with toner, thus becoming ready for a subsequent cycle of copying operation. The developing liquid as removed from the photosensitive drum 17 by the blade cleaner 42 flows along grooves $17_1$ formed around the opposite ends of the drum 17, and thence into the developing means 32 for reuse.

On the other hand, sheets of transfer paper P are contained in the cassette 6 which is removably mounted with a cassette rail $6_1$ fitted into a cassette receiving rail 154. Various types of cassette may be available in accordance with various sizes of transfer sheet and may be readily interchangeable as desired. The sheets of transfer paper P are supported on an inner plate 43 within the cassette 6 and the inner plate 43 is biased upwardly by a spring 44 so as to normally urge the pile of transfer paper P against separator pawls 45 formed on the forward end of the cassette at the opposite sides thereof. By suitably selecting the spring constant of the spring 44, the pressure force with which the sheets of transfer paper P are urged against the separator pawl 45 may be maintained substantially constant irrespective of the number of the transfer paper sheets P in the cassette 6.

When the photosensitive drum reaches its predetermined position, a signal is produced to lower a normally rotating paper feed roll 46 into contact with the uppermost sheet of transfer paper P so that the paper feed roll 46 cooperates with the separator pawl 45 to separate the uppermost transfer paper sheet P from the others and feed it leftwardly as viewed in FIG. 2. However, since register rolls $47_1$ and $47_2$ located adjacent to the cassette are stopped immediately after the feed roll 46 has been lowered, the transfer paper P fed out of the cassette 6 tends to be slack between guides $48_1$ and $48_2$ with the leading edge thereof bearing aginst the area of contact between the register rolls $47_1$ and $47_2$. Immediately thereafter, the photosensitive drum 17 produces a paper feed signal, in response to which the register rolls $47_1$ and $47_2$ start to rotate, thus feeding the transfer paper P at a speed equal to the peripheral speed of the photosensitive drum 17. On the other hand, the paper feed roll 46 is again raised away from the stock of transfer paper P after a predetermined time, and thereafter the separated transfer paper is continuously fed only by the register rolls $47_1$, $47_2$ and subsequent feed means.

The transfer paper separator belt 40 may be in the form of a narrow endless belt which passes from a separator 4oll 49 disposed in very closely spaced relationship with the photosensitive drum 17, and over a deflecting pulley 50, pulleys $52_1$, $52_2$, deflecting pulley 51, pulley $52_3$ back to the separator roll 41. The portion of the separator belt 40 extending between the pulley $52_3$ and the separator roll 49 bears against the drum 17 at a portion thereof corresponding to one end of the transfer paper sheet, and the portion of the separator belt 40 extending between the pulleys $52_1$ and $52_2$ is caused by the deflecting pulleys 50, 51 to follow a path deviated from the path of the transfer paper. The separator belt 40 is driven by the separator roll 49 at a speed substantially equal to the speed of the photosensitive drum 17. A portion of the separator belt 40 is sandwiched between one side edge of a transfer paper sheet P and the outer surface of the photosensitive drum 17 when the transfer paper P is brought into intimate contact with the photosensitive drum 17 during the image transfer process. Thus, the separation of the separator belt 40 from the photosensitive drum 17 as accomplished at the separator roll 49 will force one side edge of the transfer paper sheet P to be also separated from the photosensitive drum 17. Once its side edge is so separated, the transfer paper P may be entirely separated from the photosensitive drum 17 owing to its own self-supporting strength and to the action of the air blown from a blower 53 (FIG. 3) via a duct 54 and through an air outlet $55_1$, whereafter the transfer paper may be passed toward the drying-fixing station 41.

At the drying-fixing station 41, the unfixed transfer paper P is conveyed on a conveyor belt 57 driven by a roll 56, in the leftward direction as viewed in FIG. 2, so that the paper P is dried and fixed by the air blown from the duct 54 and intensely heated just below a heater 58. Most of the air thus heated by the heater 58 and consumed for the drying is sucked into the blower 53 (FIG. 3) through an intake port 59 disposed below the belt 57 so that such air may be circulated for reuse in the drying and fixing process. The transfer paper P thus dried and fixed may be electrically discharged by a discharger 80 so as to remove any residual charge from the surface of the paper P, whereafter it is passed via a discharge roll 61 to a discharge port 62 and discharged therethrough onto the lid 7 of the cassette 6 which also serves as a reception tray.

Figure 4:
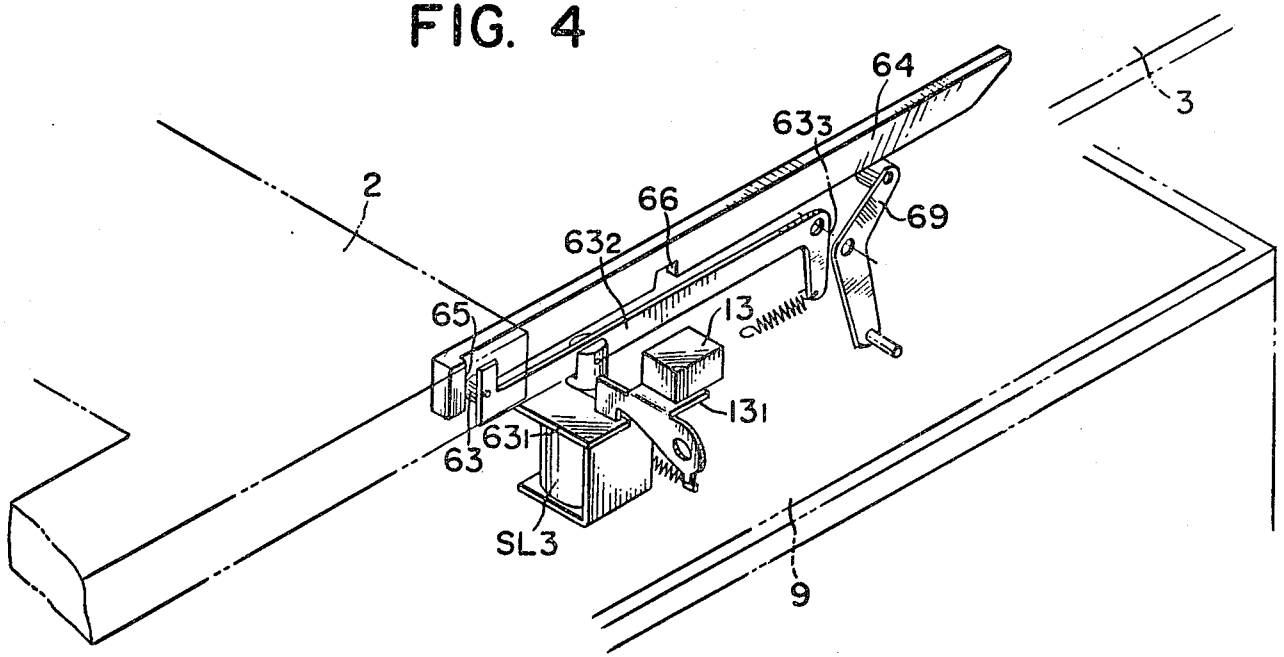
FIG. 4 is a fragmentary perspective view showing the mechanisms for fixing the original carriage.

With reference to FIG. 4, description will now be made of the operation of the above-described apparatus when used to copy book originals. The change-over of the operation mode from the foregoing mode for copying sheet originals to a mode for copying book originals may be accomplished in the manner described hereunder. The change-over button 13 is first depressed to cause counter-clockwise pivotal movement of a lever $63_2$ about a pin $63_3$ through the cooperation between a lever $13_1$ and a projection $63_1$ integral with the lever $63_2$, thus lowering a roll 63 to disengage this roll 63 downwardly from a sheet original positioning groove 65 formed at one end of a cam 64 mounted to the lower portion of the original carriage 3, which is thus allowed to move leftwardly as viewed in FIG. 2 until the roll 63 is received into a book original positioning groove 66. Such movement of the original carriage 3 from its position for sheet originals to its position for book originals cuts off the supply of electrical drive to the sheet original transport means 2, thereby changing over the entire circuit to the book original copying position. In this operative position, the forward end of a book original to be copied, i.e. the forward end $67_1$ of the original carriage's glass plate 67 (FIG. 2) assumes the position which was occupied by the lamp 19 and light receiving element 20 in the sheet original copying mode.

A book original to be copied is placed on the carriage's glass plate 67 with the forward end thereof registered with the forward end $67_1$ of the glass plate, and then the book original is held by the keep cover 4 (FIG. 2). Thereafter, the copy button 14' (FIG. 1) is depressed to produce an original start signal from the photosensitive drum 17 in the same way as described above with respect to the case of sheet original. This signal energizes an electromagnetic plunger SL3 so that upon disengagement of the roll 63 from the groove 66 the original carriage 3 is moved leftwardly as viewed in FIG. 2 and at the same speed as the peripheral speed of the photosensitive drum 17 to accomplish a through-slit exposure. Upon completion of such exposure, the original carriage 3 stops its leftward movement in response to its own signal corresponding to the size of the book original, whereupon the carriage 3 assumes its backward or rightward movement. The speed of this return movement is higher than the speed of the forward movement to increase the copying efficiency. Upon return of the original carriage to its initial position for the book original copying, the drive to the original carriage 3 is cut off to stop it with the roll 63 received in the groove 66.

Where multiple copies of the same book original are to be obtained continuously, this may readily be accomplished by means of counter means 14 operatively associated with the copy button 14'. The counter means 14 converts the movement of the original carriage 3 into a count through the cam 64 and crank 69 shown in FIG. 4, so as to hold the copy button 14' in depressed position until a preset number of copies has been counted up, thus enabling multiple copies to be provided.

In the other points, the operation of the apparatus for book originals is identical with that for sheet originals.

In the present embodiment of the copying apparatus, the photosensitive drum 17 can copy originals of variable width up to that of JIS (Japanese Industrial Standard) A3 forward and has a circumferential length somewhat greater than the length of the A3 format. Therefore, where the originals to be copied are sheet originals, one of sheet originals of A3 format may be fed for copying per full rotation of the photosensitive drum or two of sheet orignals of A4 format may be fed at a time in a direction perpendicular to the longitudinal axis thereof. If book originals are to be copied, the forward stroke (exposure stroke) of the original carriage 3 is followed by the return stroke which requires substantially as much time as the forward stroke, and thus the length of time required for providing one copy of a book original will be approximately twice the time required for one copy of a sheet original. More specifically, for originals of A3 format, one copy may be provided every two full rotations of the photosensitive drum, and for originals of A4 format, one copy may be provided per full rotation of the photosensitive drum.

Such cycle difference arising from the different sizes of paper may be detected by a signal from the cassette 6, and the cycle difference arising from the different types of original may be detected by a signal resulting from the change in position of the original carriage.

Description will now be made of the start preparation preceding to an ordinary copying cycle and of the rest position and restart succeeding to the completion of one copying cycle. As has been described above, the copying apparatus of the present embodiment is of the liquid development type whereby tener particles in the developing liquid are fixed by evaporation and desiccation of carrier liquid. Also, the blade cleaner 42, which may be formed of elastomer such as urethane rubber, nitride rubber, fluorine rubber, polysulfide rubber, acrylic rubber or the like and which is used to clean the photosensitive drum 17 to remove the toner or developing liquid remaining thereon after the image transfer, usually turned to permit a very small amount of toner to build up in the neighborhood of the cleaner's edge portion $42_1$. If the apparatus is stopped and left under such condition for many hours, the carrier collected at the edge portion $42_1$ would evaporate to solidify the toner. If the apparatus is re-started to rotate the drum 17 under such condition, the solidified toner would injure the edge $42_1$ of the cleaner 42 and/or the surface of the photosensitive drum 17 or might adversely affect the formed image on the drum surface. For these reasons, the copying apparatus of the present embodiment is arranged so that closing of the main switch 10 does not result in rotation of the drum 17 but only allows rotation of the pump in the developing means 32 (FIG. 5) to stir and introduce the developing liquid 33 upwardly into a liquid supply pipe 70 (FIG. 2) so as to pour onto the blade cleaner 42. After the solidified toner at and near the cleaner's edge portion $42_1$ is fluidized in a predetermined time, the photosensitive drum 17 begins to rotate and the fluidized toner is wiped off. After the photosensitive drum 17 has made at least one-half rotation, the rolls $18_1$ and $18_2$ of the sheet original transport means 2 begin to rotate and enable a copying cycle to take place.

On the other hand, if the power source should be left connected even after completion of the copying cycles, the photosensitive drum 17 will continue its rotation and this is not desirable in respect of the service life of the drum 17 and/or the blade cleaner 42. To avoid this, the copying apparatus of the present embodiment is also arranged so that when no further copying cycle is wanted after a previous one, the drum 17 may be automtically stopped into a rest position irrespective of "ON" position of the main switch 10. The time allowed for such rest position is selected to a value longer than the time required for a sheet of transfer paper P with a copy image thereon to be discharged out of the apparatus and for the entire surface of the photosensitive drum 17 to be cleaned up. In such rest position, depression of the re-start switch 12 in the operating portion 9 will return all the apparatus parts to the position which was taken before the rest position.

Figure 6:
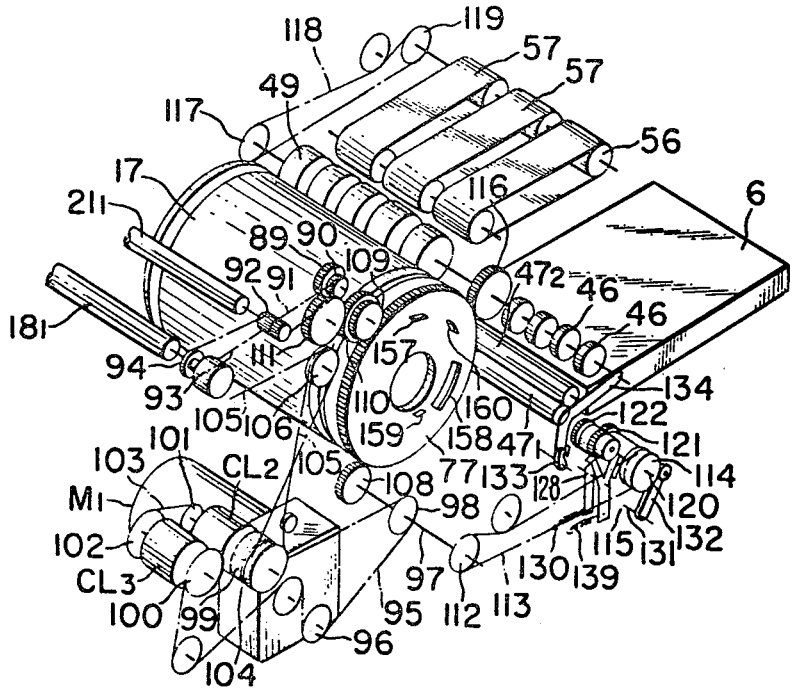
FIG. 6 is a perspective view for illustrating the drive system.

As shown in FIG. 6, the drum gear 77 is provided with a cam 157 adapted to actuate switches MS1 and MS4 to produce an original start signal, a cam 158 adapted to actuate switches MS2 and MS5 to produce a paper feed and register signal, a cam 159 adapted to actuate switches 181 and 162 to produce a jam detecting signal, and a cam 160 adapted to actuate a switch M87 to produce a drum stop signal. The cam 180 is meant to predetermine the rest position for the drum and the portion of the drum which is to stained with the cleaning blade during its rest position. The present embodiment is so designed that such stained portion of the drum may not be used as an image forming area.

Front and rear rails $5_1$ and $5_2$ are fixed to the upper ends of the frames 71 and 72 so as to slidably support the original carriage 3 by means of rollers to be described.

Figure 3:
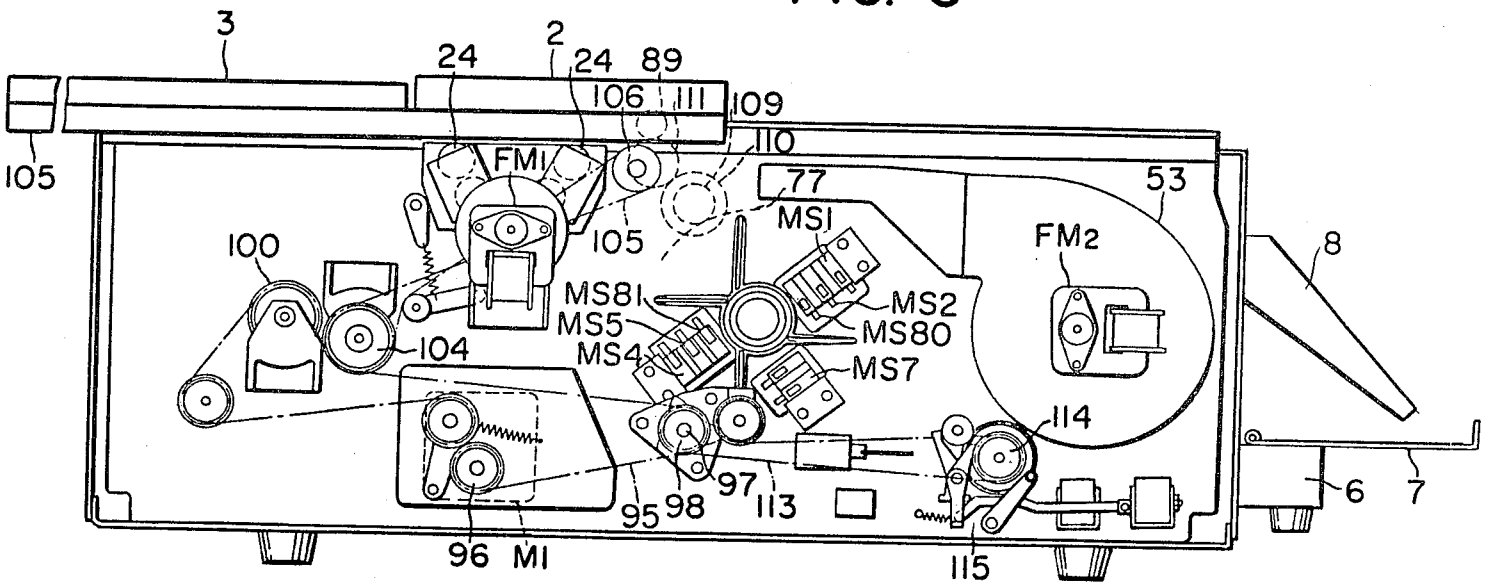
FIG. 3 is a rear side view of the FIG. 2 apparatus with the rear side cover removed therefrom.

The original carriage 3 comprises a portion for copying book originals and a sheet original transport portion 2. The sheet original transport portion 2 has a gear 89 at one end thereof as seen in FIG. 3, and this gear is driven from a drive source in the apparatus body.

Figure 7:
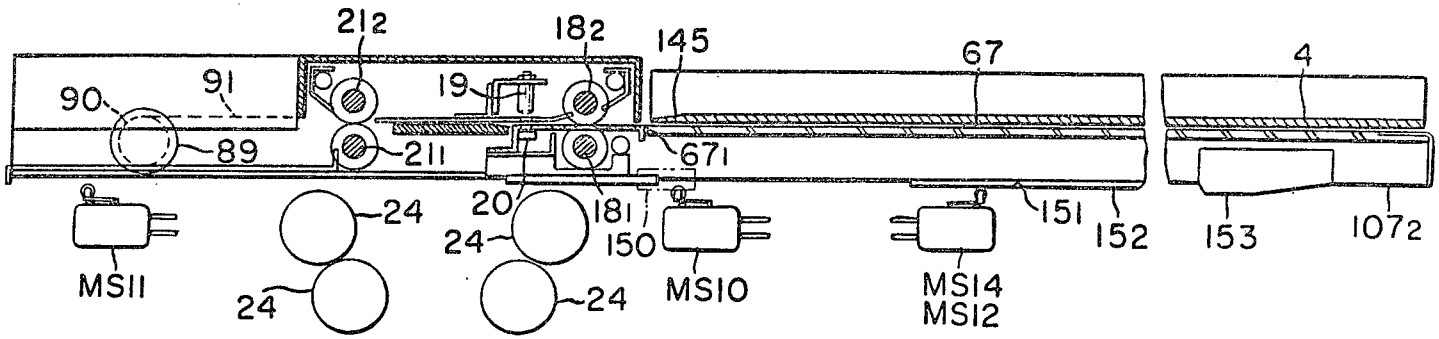
FIG. 7 is a longitudinal section of the original carriage.
Figure 8:
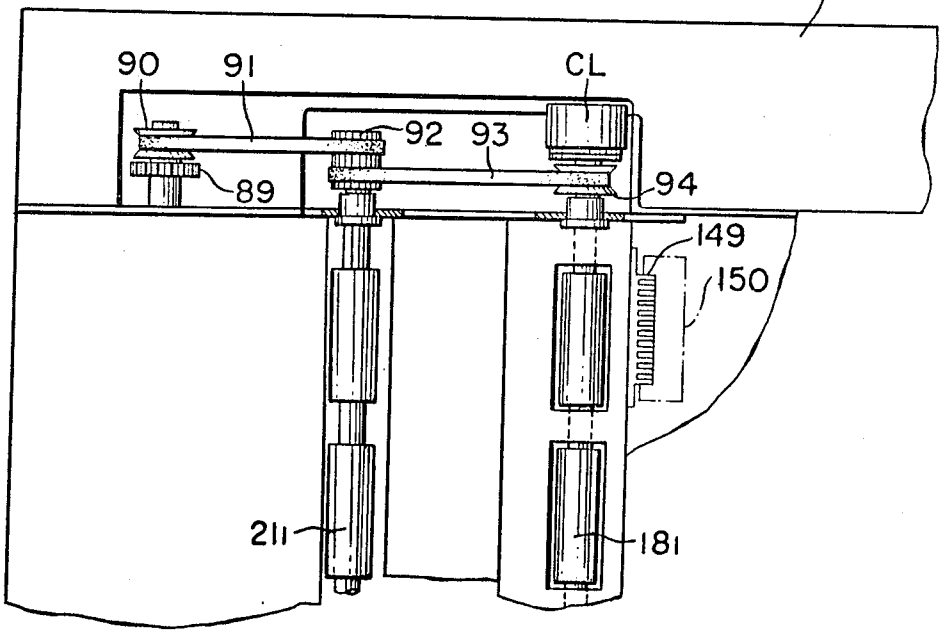
FIG. 8 is a fragmentary top plan view of the original carriage.
Figure 9:
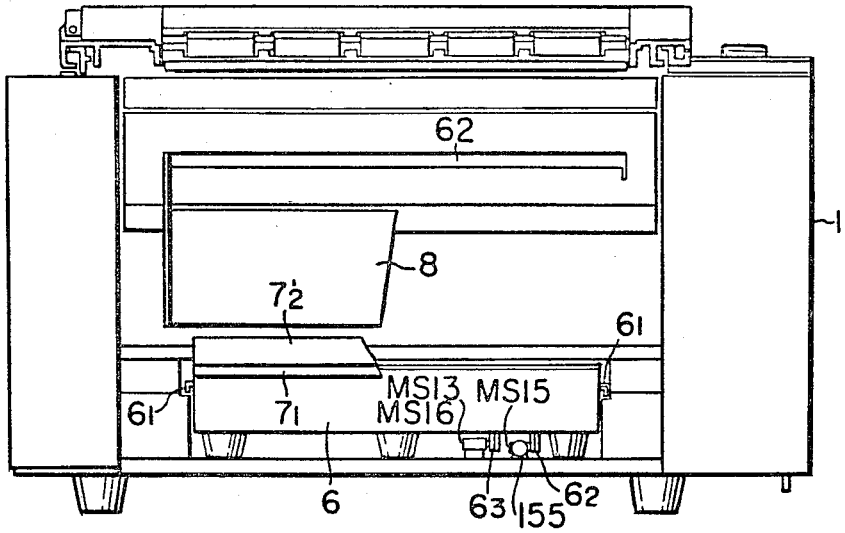
FIG. 9 is a left end view of the FIG. 1 apparatus.
Figure 10:
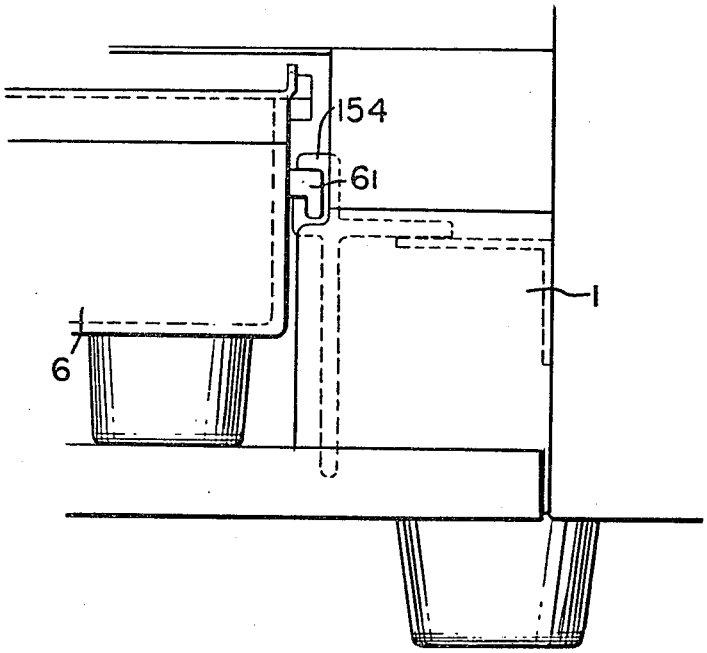
FIG. 10 is an enlarged detail of FIG. 9.
Figure 11:
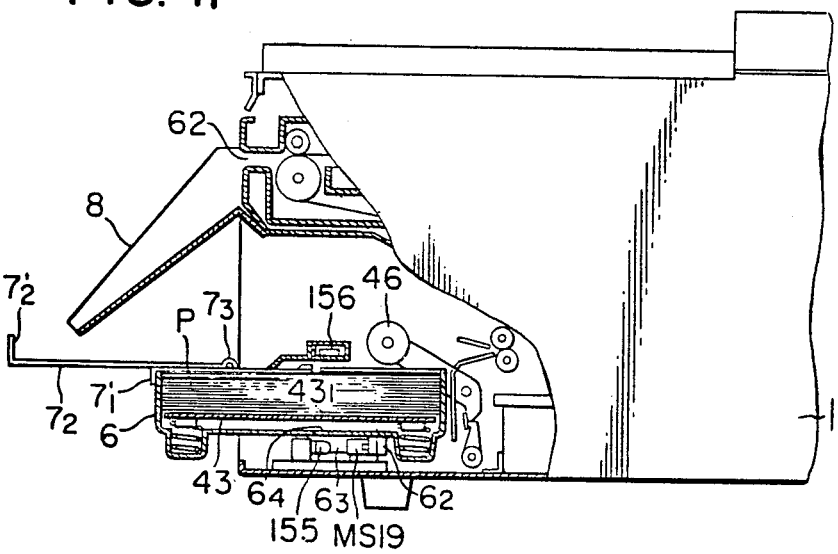
FIGS. 11 and 12 are fragmentary views, partly in cross section, of the apparatus as loaded with cassettes of different sizes.
Figure 12:
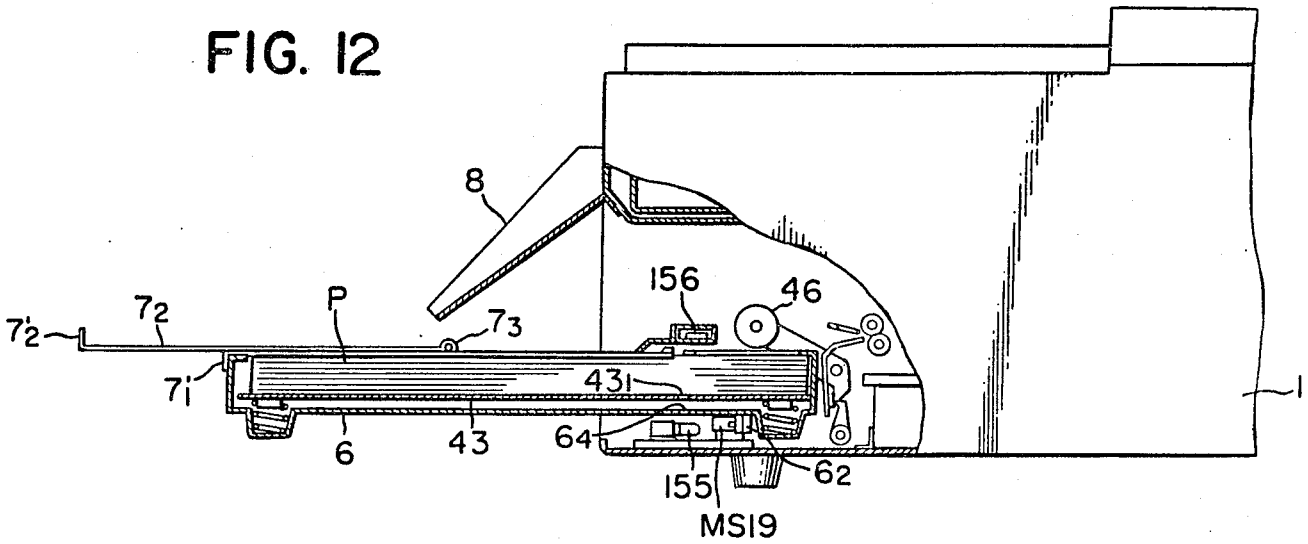
Figure 13:
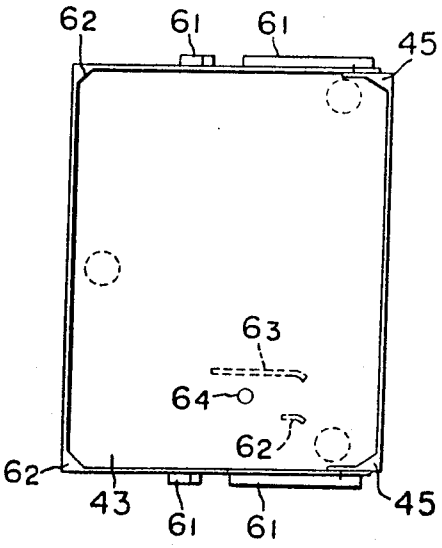
FIG. 13 is a plan view showing an embodiment of a size A4 cassette used with the present invention.
Figure 14:
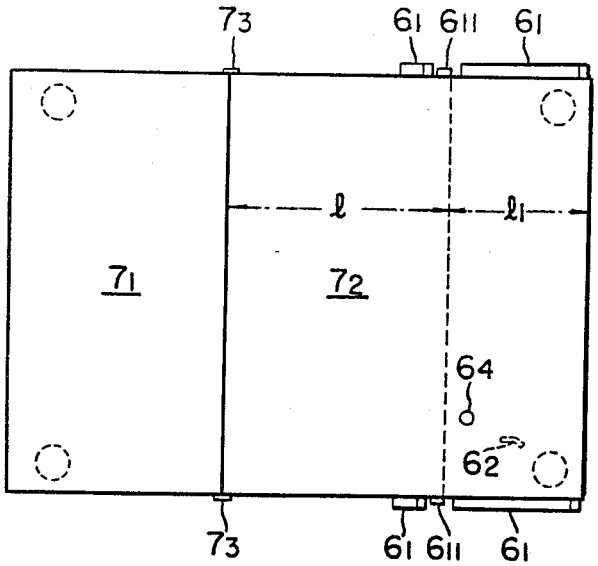
FIG. 14 is a plan view showing a size A3 cassette used with the present invention.
Figure 15:
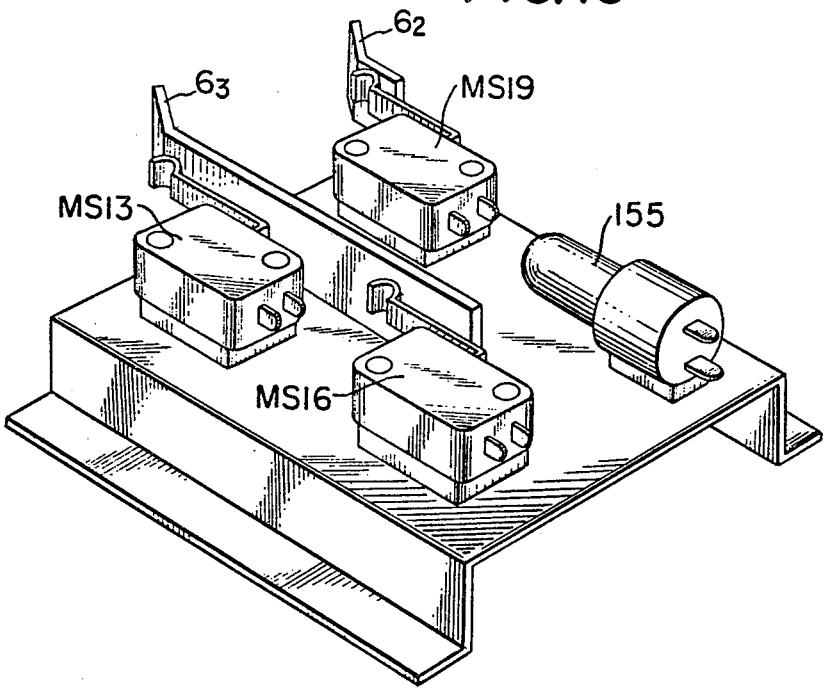
FIG. 15 is a perspective view for illustrating the relationship between the cams of said cassettes and the microswitches provided on the copying apparatus body.

Referring to FIGS. 7 and 8, the drive received by the gear 89 may be transmitted through a synchro-pulley 90 coaxial with the gear 89, a synchro-belt 91 and a synchro-pulley 92 to a roll $21_1$, and at the same time transmitted through a synchro-pulley 93 to a synchro-pylley 94, from which the drive is transmitted to a roll $18_1$ under the control of clutch CL1.

The operative connection will now be described with reference to FIGS. 3 and 6. The drive from main motor M1 is transmitted via sprocket wheel 96, chain 95, sprocket wheel 98 to drive a relay shaft 97. The chain 95 also drives sprocket wheels 99 and 100 rotatably mounted on the shafts of electromagnetic clutches CL2 and CL3. Behind the clutches CL2 and CL3, sprocket wheels 101 and 102 different in number of teeth are secured to the shafts of these clutches, and these two sprockets wheels are connected together by a drum 105. Attached to the other end of the clutch CL2 is a drum 104 on which is wound a wire 105 in several turns. The wire 105 is guided therefrom in a cross fashion to pass around a pulley 106, and has the opposite ends thereof secured to the opposite ends of an angle $107_2$ (FIG. 1) forming a part of the original carriage 3. The original carriage may be reciprocated by changing over the two clutches CL2 and CL3 to rotate the drum 104 in normal and reverse directions.

One end of the relay shaft 97 carries a gear 108 which is in meshing engagement with the aforesaid drum gear 77, so as to transmit the drive from the motor to the drum gear. Between the drum gear 77 and the gear 89 of the original carriage is a relay gear train 109–111 for transmission of the drive. Where a sheet original is to be copied, the gears 89 and 111 are in engagement as shown, but where a book original is to be copied, the original carriage is shifted to break such engagement. Another gear 116 is in meshing engagement with the drum gear 77 to drive the separator roll 49, which in turn drives conveyor belt 57 via sprocket wheel 117, chain 118, sprocket wheel 119 and drive roll 56.

The other end of the relay shaft 97 carries thereon a sprocket wheel 112 for transmitting the drive via chain 113 and sprocket wheel 114 to paper feed control means 115.

By the paper feed control means designated at 115 in FIG. 6, the paper feed roll 46 (FIG. 2) will be lowered to begin feeding paper in response to a paper feed signal. After a preceding sheet of transfer paper has passed the register roll $47_1$, this roll will be temporally stopped. Subsequently, the loading edge of a subsequent sheet of transfer paper now being fed will strike the roll $47_1$ to form a loop. When the paper feed signal disappears, the register roll $47_1$ will resume its rotation to start the transfer paper and the paper feed roll 46 will rise to its initial position. These operations are all controlled electrically and mechanically.

Referring now to FIGS. 7 and 8, a connector 149 is provided on the underside of the original carriage and connected to a connector 150 in the apparatus body. This connection is broken when a book original is to be copied, because the original carriage is slightly displaced in that case as described previously. Also provided are cams 151, 152 and 153 (FIGS. 5 and 7) on the underside of the angle $107_2$. The cam 151 is engageable with a microswitch MS14 to detect whether the original carriage is in the position for copying sheet originals or in the position for copying book originals, thereby changing over the electric circuit. The cam 152 is engageable with a microswitch MS12 to stop the original carriage when it has moved backwardly during a book original copying cycle. The cam 153 is engageable with microswitches MS10 and MS11 to produce a reversing signal for formats A4 and A3.

In the illustrated embodiment, a cassette 6 loaded with a stock of transfer paper is inserted in the apparatus body 1 by means of rolls $6_1$ and 154 (see FIGS. 9–12). A cam $6_2$ will strike a microswitch MS19 in the apparatus body and produce a signal indicating the proper positioning of the cassette. Where the cassette inserted contains paper of format A4 or smaller size, a cam $6_3$ will actuate switches MS15 and MS16 to change over the circuit into a position for copies of format A4. Cassette 6 has a semi-fixed lid $7_1$ and an openable lid $7_2$, which may be opened upon insertion of the cassette and also may serve as copy receiving tray. Separator pawl 45 are provided at the opposite sides of the paper feed end of the cassette 6.

Figure 18:
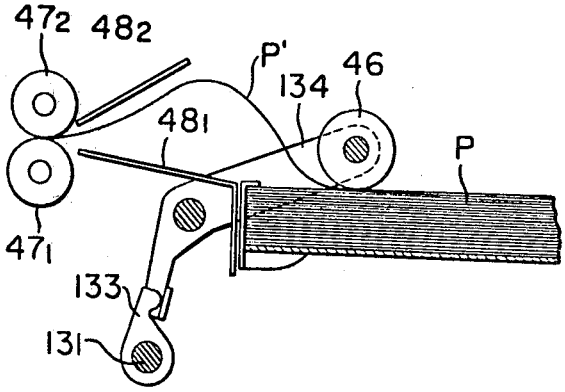
FIG. 18 illustrates the paper feed means of the present invention.

An embodiment of the paper feed means according to the present invention will now be described in detail. In FIG. 18, an uppermost sheet P′ of copy paper stock P is fed by paper feed roll 46 and the leading edge thereof strikes against the nip between register rolls $47_1$ and $47_2$ which are then stationary, so that the fed sheet will form a loop as indicated by P′. Subsequently, the register rolls $47_1$ and $47_2$ are driven by a signal from the apparatus, thus timing the paper feed. The operation of the paper feed roll and the register rolls has conventionally been controlled in the following manner: As soon as the drive to the paper feed roll 46 is connected, the drive to the register rolls $47_1$ and $47_2$ is disconnected to stop the register rolls; subsequently, the loop of the copy paper P′ is formed, whereupon the drive to the register rolls is connected and at the same time the drive to the paper feed roll is disconnected. According to this method, there are provided only two positions, i.e. a position in which the paper feed roll is stationary while the register rolls are rotating and a position in which the paper feed roll is rotating while the register rolls are stationary. Therefore, control of these positions may be simply accomplished by a single switch having a normally open contact and a normally closed contact corresponding to the said two positions, respectively.

Such a system has a demerit that no subsequent feed cycle is allowed before the leading edge of preceding copy sheet has passed through the register rolls, but such a demerit would lead to no essential inconvenience in the copying apparatus of the type using a reciprocable optical system, because this provides the time allowance for the return stroke.

However, if the aforesaid conventional system is used with a copying apparatus for sheet originals wherein no return stroke is involved and originals can be inserted in succession, paper feed means would encounter a barrier in accelerating the copying speed.

The present invention also intends to provide paper feed means which can reduce the time interval between a preceding copy sheet and a subsequent copy sheet by the use of a control circuit identical with the conventional system.

FIG. 18 shows an embodiment of such paper feed means. In this embodiment, paper feed roll 46 is normally driven to rotate from a drive source in the apparatus body. The paper feed roll 46 may also be vertically moved by reciprocal movement of paper feed control shaft 131 via paper feed lever and arm 133 and 134, so that the paper feed roll 46 may ride on the stock of copy paper P with the aid of its own weight or spring action so as to assume a paper drive position for feeding an uppermost paper sheet P′, and may be raised away from the stock of paper Pso as to assume a paper feed stop position. The register rolls $47_1$ and $47_2$ can repeat rotation and stoppage alternately.

Figure 19:
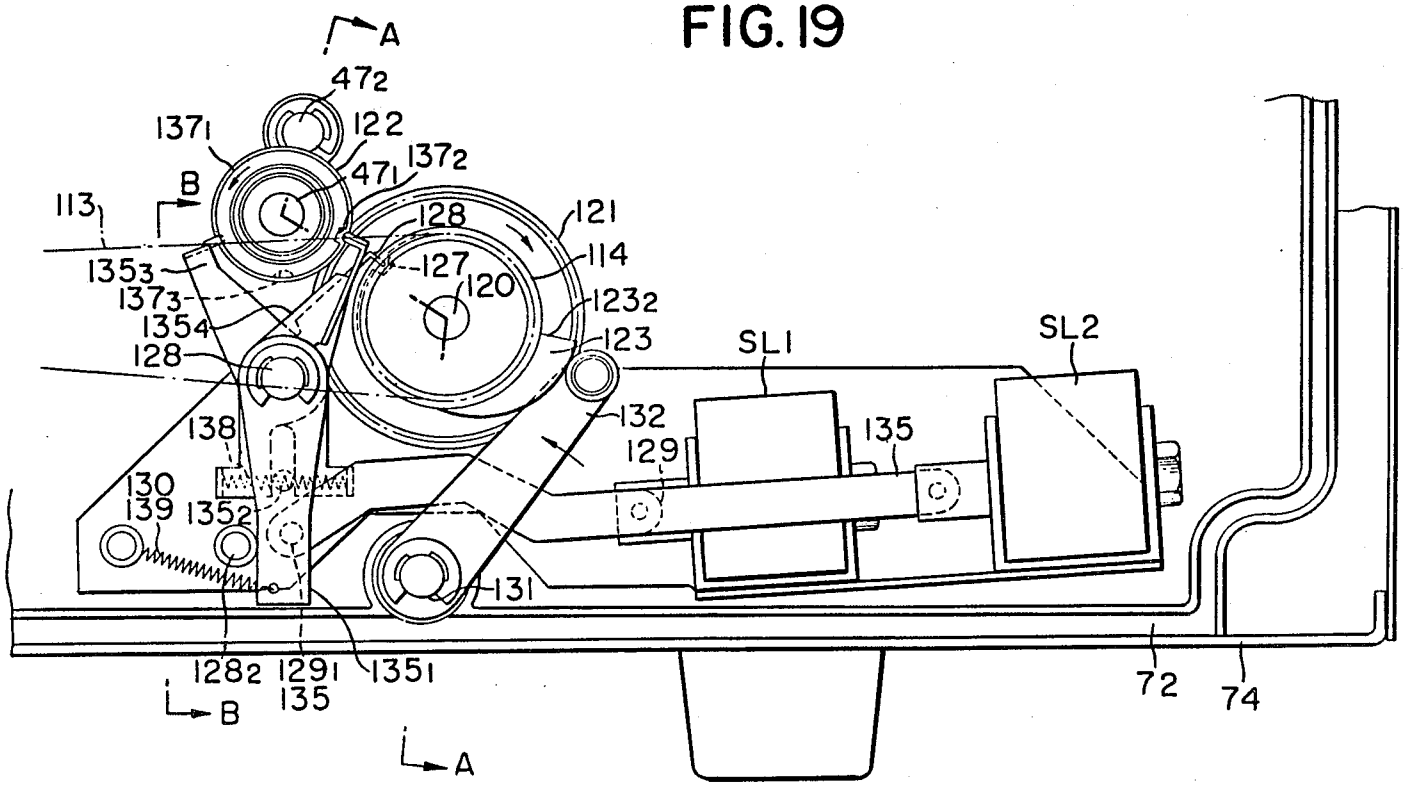
FIG. 19 is a front view showing an embodiment of the paper feed means.

As shown in FIG. 19, solenoids SL1 and SL2 are provided to effect the aforesaid control of the paper feed roll 46 and register rolls $47_1$, $47_2$. These solenoids may be energized by a single microswitch having a normally open contact and a normally closed contact, i.e. by a single paper feed signal. When a paper feed signal enters in synchrohism with the rotation of the photosensitive drum 17, the normally open contact is closed to energize the solenoid SL1 so that the roll 46 is lowered to start paper feed. At the same time, the normally closed contact is opened to deenergize the solenoid SL2, but the register rolls $47_1$ and $47_2$ should not be allowed to stop their rotation before the leading edge of a preceding copy sheet P has passed through these rolls. Therefore, the rolls $47_1$ and $47_2$ continue to rotate until the preceding copy paper has completely passed therethrough. After the rolls $47_1$ and $47_2$ have stopped rotating, the leading edge of a succeeding copy sheet P' strikes the nip between the rolls $47_1$ and $47_2$ so that the copy sheet P' forms a loop. Thereafter, the paper signal is cut off to deenergize the solenoid SL1 and energize the solenoid SL2, so that the register rolls $47_1$ and $47_2$ resume their rotation to start the copy sheet P', whereupon the paper feed roll 46 is raised to stop its paper drive. Thus, timed paper feed cycles may be mechanically accomplished according to the present invention.

Figure 20:
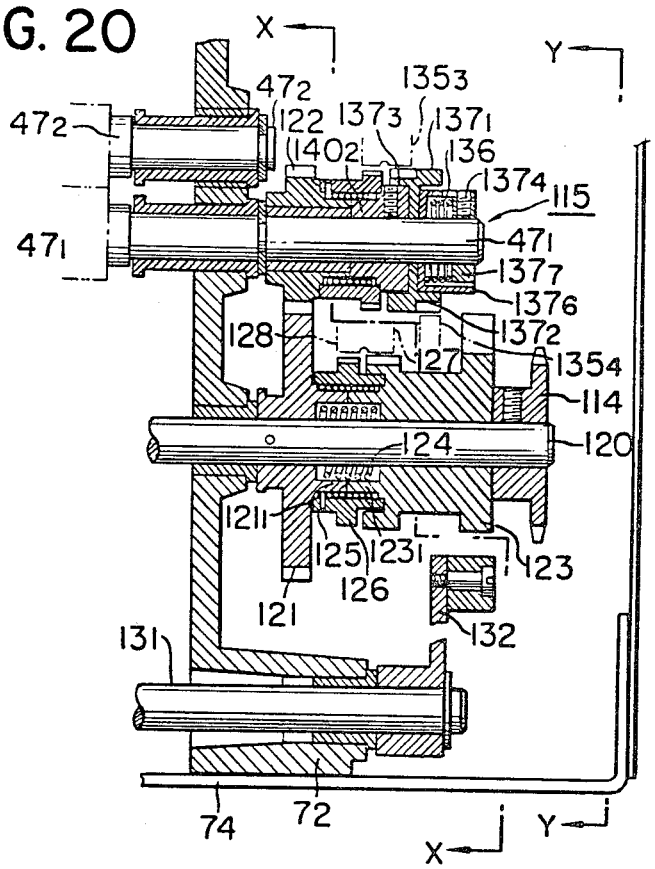
FIG. 20 is a cross-sectional side view taken along lines A—A of FIG. 19.

In FIGS. 19 and 20, shaft 120 is normally rotated as a paper feed control drive source via chain 113 and sprocket 114. A gear 121 secured to the shaft 120 has a cam 123 connected thereto by means of spring clutch 125. The cam 123 is adapted to pivotally move a cam follower 132 to thereby rotate the paper feed control shaft 131. The drive of the gear 121 is also transmitted to a gear 122 which is free relative to the shaft to the register roll $47_1$, and the gear 122 in turn drives the roll $47_1$ via a spring clutch 140. The aforesaid timed paper feed cycles may be provided by controlling the operation of the spring clutch 140 through a time delay mechanism.

When no paper feed takes place, the solenoids SL1 and SL2 are in inoperative and operative conditions, respectively. In such a case, the cam 123 pivotally moves the cam follower in clockwise direction as viewed in FIG. 19, and accordingly the shaft 131 and lever 133 (FIG. 18) are also pivotally moved in the same direction, thus raising the paper feed roll 46 away from the stock of copy paper P. Thus, with the solenoids being inoperative, the paper feed control lever 128 connected to link 129 by pin $129_1$ is pulled by spring 130 to rotate clockwise about the shaft $128_1$ until the lever strikes against a stop $128_2$, whereby the end pawl of this lever is engaged in a notch 127 formed in the flange of the cam 123 adjacent to the clutch 125, thereby stopping the cam 123 in that position, and at the same time, actuating a minute pawl on the circumferential surface of the outer wheel 126 of the spring clutch 125 to loosen the spring and disengage the clutch 125, thus cutting off the drive to the cam 123. A spring 124 for preventing reverse rotation is provided between an inner clutch wheel $121_1$, integral with the gear 121 and an inner clutch wheel $123_1$ integral with the cam 123.

Figures 22, 24:
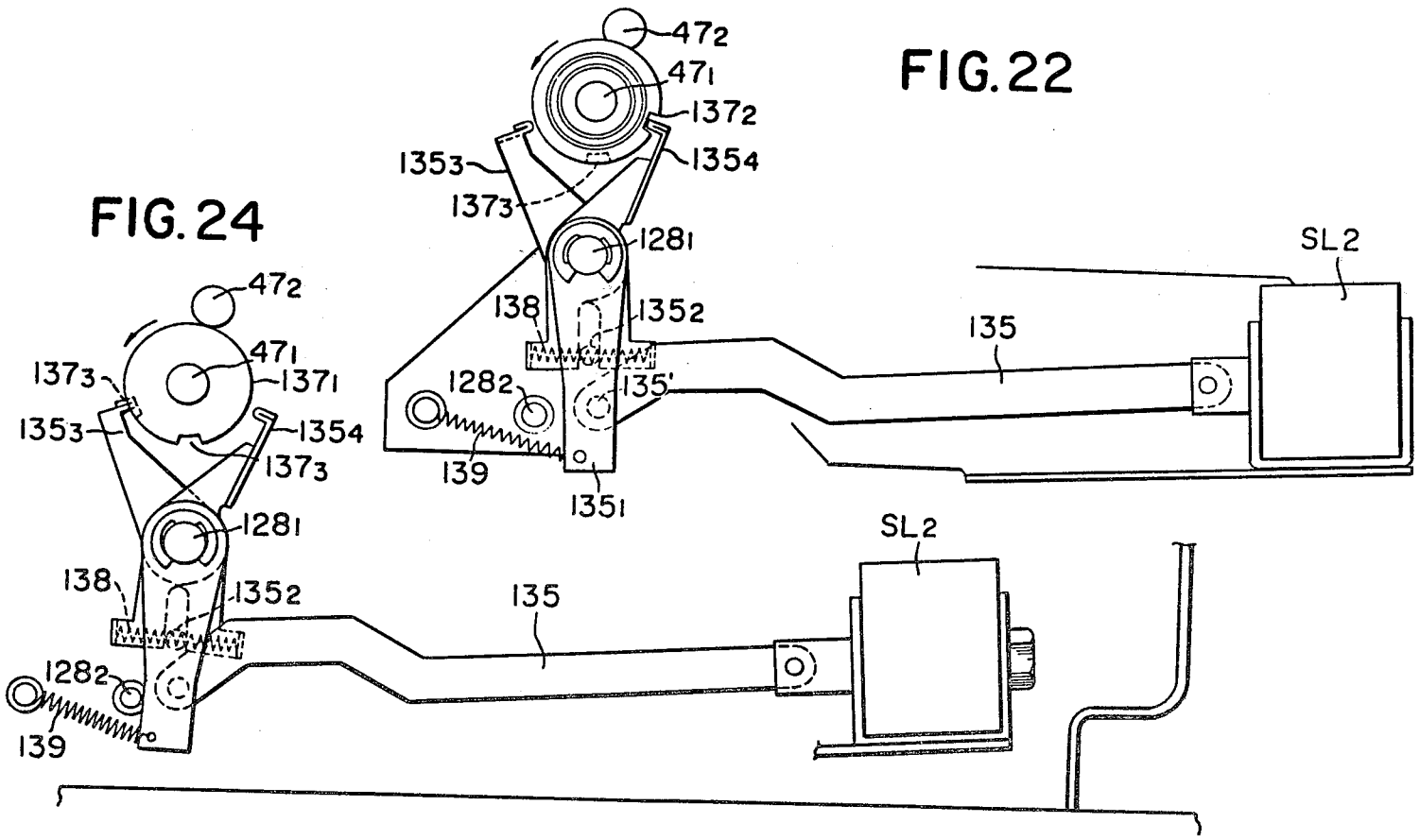

Solenoid SL2 attracts link 135 rightwardly as viewed in FIG. 19 or 22, thus rotating pin 135' and lever $135_1$ in counter-clockwise direction. This causes pin $135_2$ or lever $135_3$ formed on the lever $135_1$ to be actuated in counter-clockwise direction, thereby disengaging the upper end pawl of the lever $135_3$ from the surface of delay drum $137_1$ which is free relative to the shaft of the register roll $47_1$. A lever $135_4$ connected to the lever $135_4$ by a spring 138 is also rotated counter-clockwise to engage its upper end pawl in the notch $137_1$ of the delay drum $137_1$. Thereupon, the register roll $47_1$ is driven by gears 121, 122 through spring $140_1$ and driven shaft $140_2$ of the spring clutch 140. The delay drum $137_1$, which is urged against the driven shaft $140_2$ by spring receiver $137_7$ and spring 136 secured to the register roll shaft $47_1$ and frictional keep ring $137_6$ slidably mounted on that shaft through the cooperation between pin $137_4$ and slot $137_5$, is prevented from rotating by the engagement between the said pawl $135_4$ and the notch $137_2$.

Figures 21, 25:
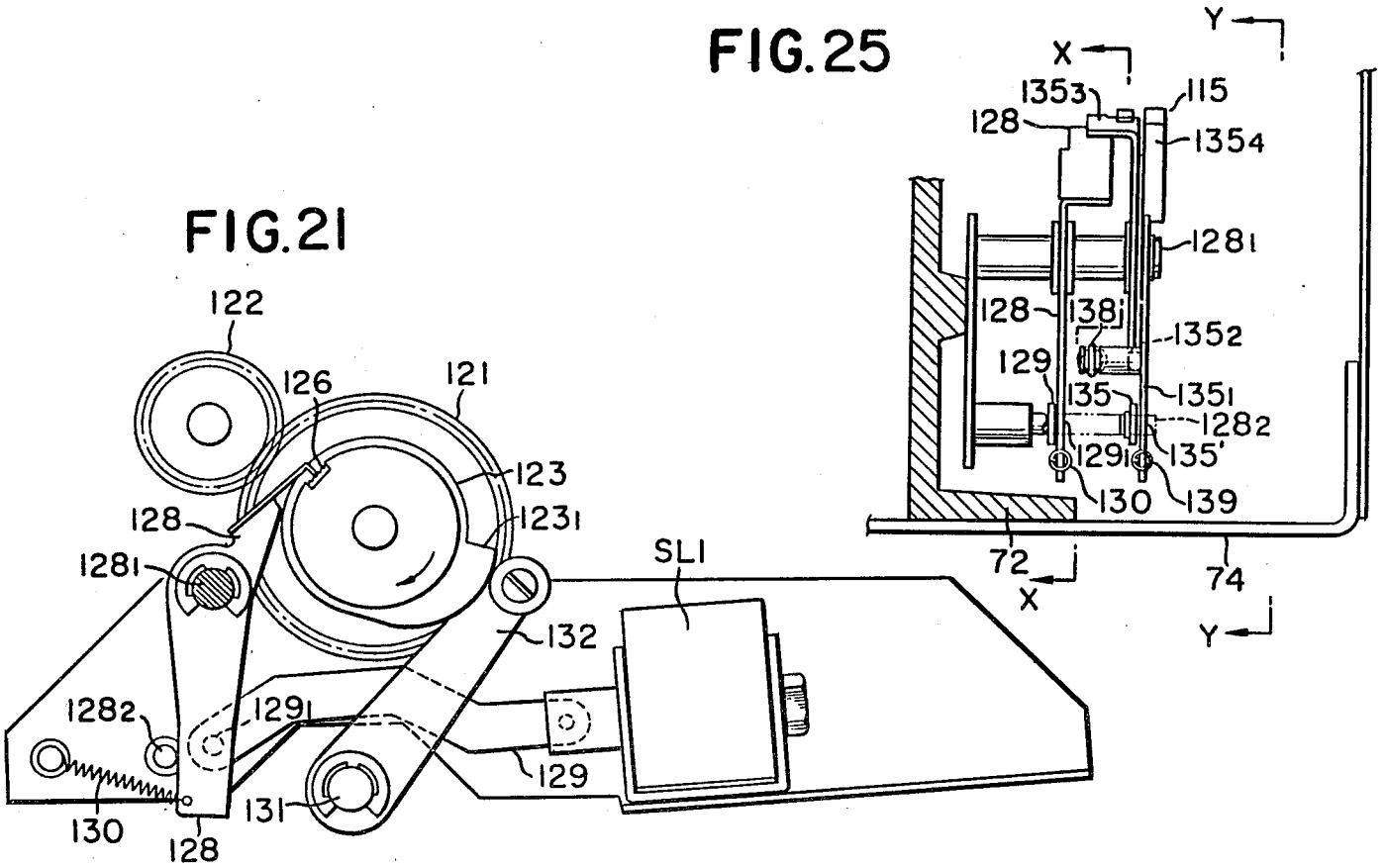
FIG. 21 is a front view of the paper feed control mechanism taken along lines X—X of FIGS. 20 and 25.
FIG. 25 is a side view taken along lines B—B of FIG. 19.

When a paper feed signal enters, solenoids SL1 and SL2 are energized and deenergized, respectively, by a common switch, as described previously. In FIG. 21, link 129 and lever 128 are actuated to release cam 123 and outer clutch wheel 126, so that the drive from the gear 121 is transmitted to spring 125 and cam 123, which is thus rotated clockwise to cause cam follower 132 to drop into the recessed step $123_2$ of the cam 123 and pivotally rove in counter-clockwise direction, whereupon the paper feed roll 46 rides on the stock of copy paper P to start paper feed.

Figure 23:
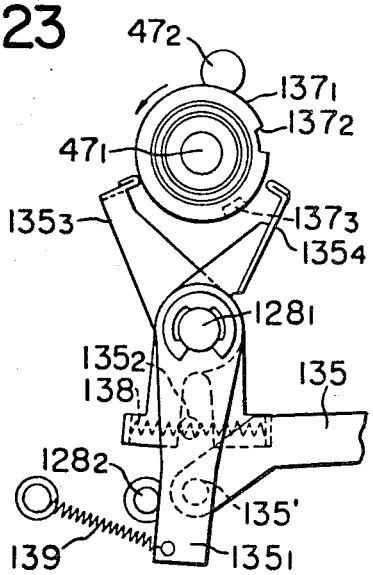
FIGS. 22 to 24 are front views of the register roll control mechanism taken along lines Y—Y of FIGS. 20 and 25.

Upon deenergisation of the solenoid SL2, the lever $135_1$ is pulled back by the spring 139 and the lever $135_4$ is rotated clockwise, so that the delay drum $137_1$ is frictionally driven to rotate counter-clockwise by the driven shaft $140_2$. The lever $135_3$ is urged against the surface of the drum by the spring 138 (FIG. 23).

During the while the delay drum $137_1$ rotates about 300° as shown in FIG. 24, the preceding copy sheet has passed through the register rolls $47_1$, $47_2$ and the leading edge of the subsequent copy sheet has not yet reached the register rolls. At this point of time, the end pawl of the lever $135_3$ is engaged with another notch $137_3$ formed in the delay drum $137_1$ to prevent the rotation of the drum $137_1$ and at the same time to hold the coarse surface (or minute pawls) of the outer clutch wheel 140. As a result, the clutch spring $140_1$ is loosened to cut off the drive to the register roll $47_1$.

Thus, the leading edge of the copy sheet fed by the paper feed roll 46 strikes the nip between the register rolls $47_1$ and $47_2$ which are now stationary, so that the copy sheet forms a loop to provide timing for the copying.

When the paper feed signal disappears, the solenoid SL2 attracts the link 135 to disengage the lever $135_3$ from the notch $137_3$ and thereby release the outer clutch wheel 140, so that the register roll $47_1$ is rotated to start the copy sheet.

Thereupon, the solenoid SL1 is deenergized, but because the lever 128 is then riding on the circumferential surface of the cam 123 (which is greater in diameter than the outer clutch wheel 126), the cam 123 is rotated to actuate the cam follower 132 to raise the paper feed roll 46, whereupon the notch 127 is engaged by the lever 128 to bring about the position of FIG. 21 in which the cam 123 is stopped.

The delay drum $137_1$ is stopped at the position of FIG. 22 where the notch $137_2$ thereof is engaged by the lever $135_4$, and thus it is ready for a subsequent cycle.

In the above-described embodiment, the paper feed roll 46 is vertically moved to control the paper feed, but alternatively the control may be accomplished by intermittantly rotating the paper feed roll while making it always bear against the stock of copy paper. In this latter case, the cam 123 may be replaced by a gear to rotate and stop the shaft of the paper feed roll 46.

Further, in the apparatus of the type in which an original carriage or an optical system for the through-slit exposure is reciprocated, the paper feed signal may also be produced by such reciprocating member.

The present invention is characterized in that a single signal source or a single drive source is used to accomplish a cycle of operation which comprises the steps of starting the paper feed by means of the paper feed roll 46, completing the feeding of a preceding copy sheet through the register rolls $47_1$, $47_2$ and stopping these rolls, feeding a subsequent copy sheet until the leading edge thereof reaches the register rolls to form a loop, starting the paper feed action of the register rolls, and stopping the rotation of the paper feed rolls.

To accomplish this, there is provided a transmission system leading from drive source 114, 120 via clutch 125 to rotatable paper feed control member 123, and a transmission system leading from the drive source via clutch 140 to register rolls $47_1$, $47_2$. Thus, a paper feed signal enters to release the rotatable control member 123 from its blocked position (resulting as from members 126–130) and thereby start the paper feed while starting to rotate timing members (such as delay drum $137_1$, link 135, levers $135_1$, $135_3$, $135_4$) which control the clutch in the transmission system leading to the register rolls after a predetermined time (i.e. the time required for a preceding copy sheet to completely pass through the register rolls $47_1$, $47_2$), the timing members are operated to stop the register rolls $47_1$, $47_2$, whereupon the leading edge of a subsequent copy sheet strikes these rolls to form a loop thereafter the paper feed signal is cut off to stop the paper feed, whereupon the register rolls $47_1$ and $47_2$ reverse their directions of rotation to start the copy sheet nipped therebetween. In this way, paper feed can be effected with accurate timing.

Moreover, the construction for this purpose can be provided by a relatively simple mechanical construction.

Furthermore, when applied to the copying apparatus of the type which permits successive insertion of originals, as described previously, the paper feed system of the present invention enables successive originals to be received in synchronism with the paper feed speed provided by the present invention, thus enhancing the copying speed.

An embodiment of the means for repeating the copying cycle in the copying apparatus of the present invention will be described hereunder. Such means is effectively applicable to repeat the copying cycle as frequently as desired. For example, where each ten copies of five different originals are to be obtained by the copying apparatus of the present invention, the number of copies desired may be set to the value "10", whereafter a first original may be set in position and then a copy button depressed, whereby the apparatus will continue its operation until ten copies of the first originals are produced, whereupon the apparatus is stopped. Simply by depressing the copy button again, the same process may be repeated for each of the other four originals, thus providing ten copies of them each.

With the conventional system for such repeated operation, resetting to a set value has taken place during the depression of the button and this could cause an error in the desired number of copies because the resetting could not be completed if the button was released after a short-time depression. According to the present invention, however, no such error can occur because once the copying cycles up to a set value has been completed, the resetting to the set value is automatically effected as will be described below.

Description will finally be made of the electric control in an embodiment of the copying apparatus according to the present invention.

In the copying apparatus according to the previous embodiment, the original carriage 3 is provided with a book original carriage means 67 (glass plate) and a sheet original transport means 2 supported on the angles slidable along rails $5_1$, $5_2$ by means of rollers. The sheet original transport means has a gear 89 at the forward end thereof, and this gear is driven from drum gear 77 integral or coaxial with photosensitive drum 17 via relay gears 109–111, as shown in FIGS. 3 and 4. The drive imparted to the gear 89 is transmitted via synchro-pulleys 90, 92 and synchro-belt 91 to roll $21_1$, and further via synchro-belt 93 to pulley 94, and thence to roll $18_1$ under the control of clutch CL1. The drive from main rotor M1 of FIG. 2 is transmitted via sprocket wheel 96, chain 95, sprocket wheel 98, relay shaft 97 and gear 108 to drive drum gear 77 and photosensitive drum 17. When sheet originals are to be copied, gears 89 and 11 are in engagement, but when book originals are to be copied, gear 89 is displaced out of engagement with gear 11 as described below.

Chain 95 also drives sprocket wheels 99 and 100 rotatably mounted on the shafts of electromagnetic clutches CL2 and CL3. Behind the clutches CL2 and CL3, sprocket wheels 101 and 102 different in number of teeth are secured to the shafts of these clutches, and these two sprocket wheels are connected by a chain 103. Attached to the shaft of the clutch CL2 is a drum 104 on which is wound a wire 105 in several turns. The wire 105 is guided therefrom in a cross fashion to pass around a pulley 106, and has the opposite ends thereof secured to the front and rear ends of the original carriage 3. The original carriage may be reciprocated by selectively using the two clutches CL2 and CL3 to rotate the drum 104 in normal and reverse directions. The gear ratio of gears 101 and 102 is selected such that the return stroke of the carriage may be faster than the forward stroke.

When copying operation is started and preparatory operations for developing and other various means are completed, the photosensitive drum 17 begins rotating while the original carriage 3 is stopped in its normal position for copying sheet originals with gears 39 and 111 in engagement and with rolls $21_1$, $21_2$, $18_1$, $18_2$ being in rotation. When a sheet original is inserted from the right of the apparatus into the nip between rolls $18_1$ and $18_2$, it is transported leftwardly. As soon as the leading edge of the sheet original is detected by lamp 19 and light receiving element 20, the rolls $18_1$ and $18_2$ are temporally stopped from rotating, and thus the original is also stopped.

When the photosensitive drum 17 comes to a predetermined position, the cam 157 of drum gear 77 actuates microswitches MS1 and MS4 (operable for format A4 or smaller sizes) in succession to produce an original start signal, whereupon the rolls $18_1$ and $18_2$ resumes their rotation so that the original is further transported leftwardly in synchronism with the rotation of the photosensitive drum 17 and discharged upwardly out of the apparatus by rolls $21_1$ and $21_2$.

Change-over of the operation mode to a book original copying mode may be accomplished by depressing change-over button 13 to cause counter-clockwise pivotal movement of lever $63_2$ about pin $63_3$, as viewed in FIG. 4, through the cooperation between lever $13_1$ and projection $63_1$, thus lowering roll 63 to disengage this roll downwardly from sheet original positioning groove 65 formed in cam 64 mounted to the lower portion of the original carriage 3. When the original carriage 3 is moved leftwardly, the roll 63 is received into book original positioning groove 66 by means of spring $63_4$, and the sheet original transport means 2 is also moved with the carriage 3 to break the engagement between gears 89 and 111. At this time, the forward end $67_1$ of the original carriage's glass plate 67 assumes the position which was occupied by the photoelectric means 19, 20 during the sheet original copying mode.

Thereupon, a book original to be copied is placed on the carriage's glass plate 67 with the forward and thereof registered with the forward end $67_1$ of the glass plate, and then the book original is held by the keep cover 4 (FIG. 2). Thereafter, the copy button 14' (FIG. 1) is depressed to produce an original start signal from the photosensitive drum 17 in the same way as described above with respect to case of sheet original. This signal energizes an electromagnetic plunger SL3 so that upon disengagement of the roll 63 from the groove 66 the original carriage 3 is moved forwardly in synchronism with the photosensitive drum 17 to accomplish a through-slit exposure.

Upon completion of such exposure, the original carriage 3 stops the movement in response to its own signal corresponding to the size of the book original, whereupon the carriage 3 measures its rapid backward movement and stops at its start position determined by roll 63 and groove 66.

Where multiple copies of the same book original are to be obtained continuously, this may readily be accomplished by means of the aforesaid counter means 14 operatively associated with the copy button 14'. At each reciprocal movement of the original carriage, cam 64 and crank 69 are rotated to actuate the ratchet mechanism of the counter means so that the original carriage 3 is reciprocated as frequently as the set number of copies, whereafter the copy button 14' is released to stop the original carriage 3.

In the present embodiment of the copying apparatus, the photosensitive drum 17 can copy originals of variable width up to that JI6 A3 end has a circumferential length somewhat greater than the length of A3 format. Therefore, where the originals to be copied are sheet originals, one of sheet originals of A3 format may be fed for copying per full rotation of the photosensitive drum or two of sheet originals of A4 format may be fed actuating in a direction perpendicular to the longitudinal axis thereof. If book originals are to be copied, the forward stroke (exposure stroke) of the original carriage 3 is followed by the return stroke which requires substantially as much time as the forward stroke, and thus the length of time required for providing one copy of a book original will be approximately twice the time required for one copy of a sheet original. More specifically, for originals of A3 format, one copy may be provided every two full rotations of the photosensitive drum, and for originals of A4 format, the copy may be provided per full rotation of the photosensitive drum.

Such cycle difference arising from the different sizes of paper may be detected by a signal from the cassette 6, and the cycle difference arising from the different types of original may be detected by a signal resulting from the change in position of the original carriage.

Formats A3 and A4 are taken as examples in the illustrated embodiment. As shown in FIGS. 13–16, a cassette for format A4 or smaller size of paper (FIG. 13) or a cassette for format A3 (FIG. 14) is provided with a pawl $6_2$ for providing a signal representing th completion of the cassette loading through microswitch MS19. The cassette for format A4 or smaller size (FIG. 13) is provided with a cam $6_3$ for actuating microswitches MS13 and MS16. Photoelectric means 155 and 156 are provided to detect the presence of transfer paper through apertures $6_4$ and $43_1$ formed in the bottom and intermediate plates of the cassette, respectively.

Figure 5:
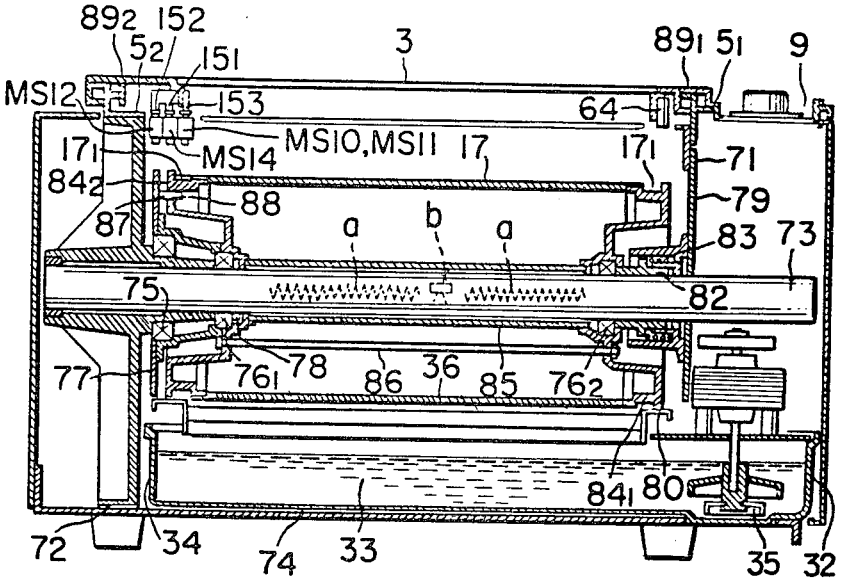
FIG. 5 is a transverse section of the same apparatus.

As shown in FIG. 5, cams 151–153 are provided on the underside of the original carriage 3. The cam 151 actuates microswitch MS14 to detect a position of the original carriage corresponding to the original thereon. More specifically, when the original carriage is in the shown position for sheet oroginals, the cam 151 opens the change-over microswitch MS14-a in the book original control circuit of the circuitry shown in FIG. 16. The cam 152 actuates microswitch MS12 to stop the original carriage 3 at a predetermined position. The cam 153 actuates microswitch MS10 for originals of A4 or smaller size, and actuates microswitch MS11 for originals of A3 size, thereby providing a signal for moving the original carriage is reverse direction.

Figure 16:
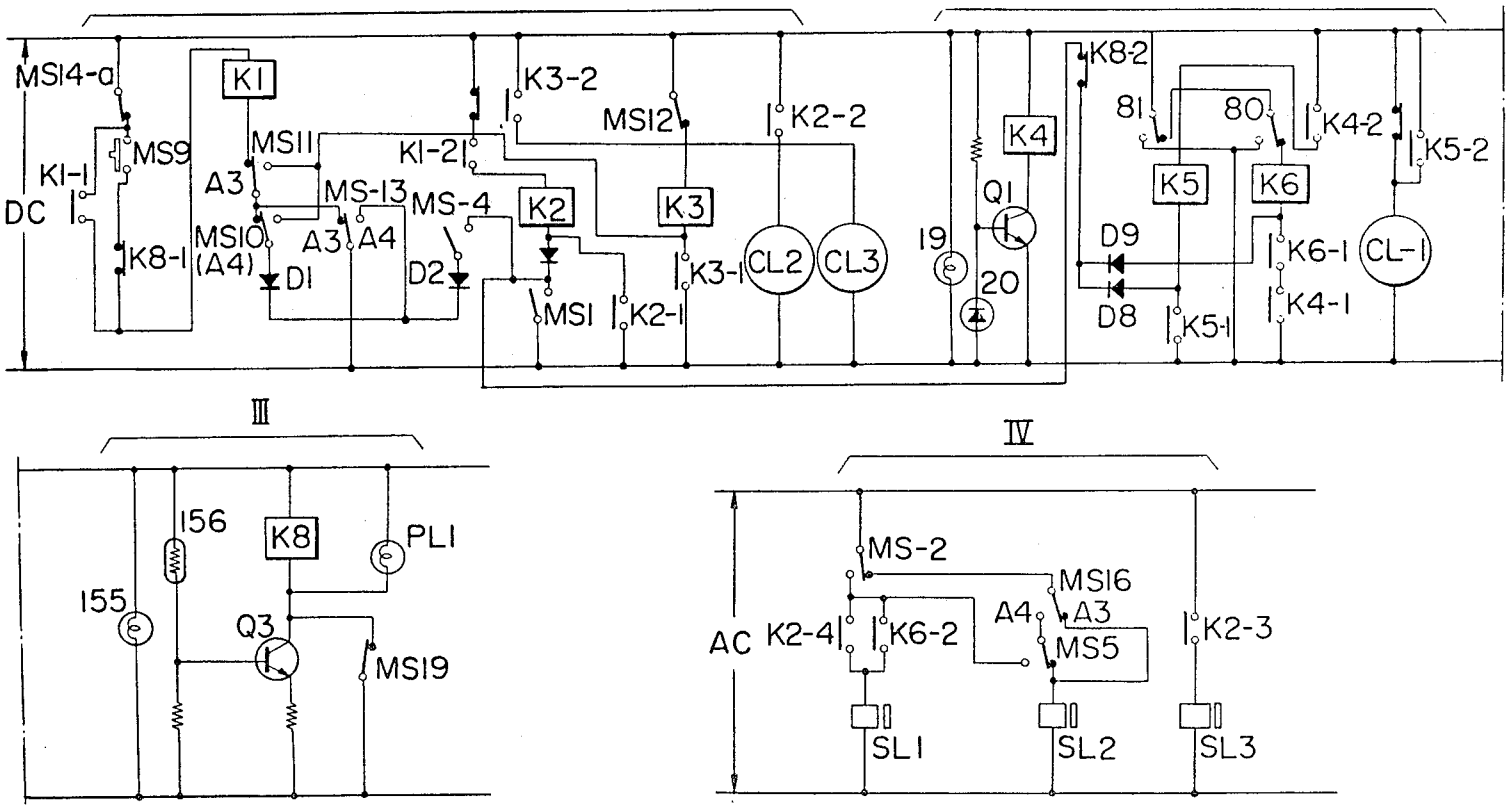
FIG. 16 is a diagram of the electric circuit for controlling the operation of the copying apparatus according to an embodiment of the present invention.

The electric control circuit arrangement for controlling various parts of the copying apparatus will be described with reference to FIG. 16.

I. Sheet Originals

Before a sheet original is transported to the sheet original transport means 2 on the original carriage 3, the light receiving element 20 forming the original detecting photoelectric means 19, 20 will produce an electromotive force, and transistor Q1 and accordingly original detecting relay 19 will be in OFF state. Through the normally closed contact K4-2 of the relay K4, electromagnetic clutch CL1 will be energized to drive gear 89 which in turn will drive original transport roll $18_1$.

When a sheet original is transported by rolls $18_1$, $18_2$ and the leading edge thereof reaches the detector means 19, 20, transistor Q1 and relay K4 will assume ON state and the normally closed contact K4-2 of the relay K4 will be opened to deenergize clutch CL1, thus stopping the original temporally.

When the cam 157 of rotating drum gear 77 closes original start microswitch MS1 (FIG. 3), relay K5 will be energized through a circuit of K4-2 - K5 - D8 - K8-2 - MS1, and self-hold with the aid of contact K5-1, so that clutch CL1 will be energized through contact K5-2, thus starting transportation of the sheet original.

At the same time, a cassette when inserted will intercept the light to photoelectric means 153, 156 so that transistor Q3, cassette insertion signal microswitch MS19 and paper stock deficiency indicator lamp PL1 will all be in OFF state, and thus normally closed contact K8-2 remains closed.

Where the transfer paper P in the cassette 6 is of size A3, microswitch MS13 closes its contact A3 and microswtich MS16 is open. When the drum 17 is further rotated to actuate a subsequent original start microswitch MS4, no response will occur for an original of size A3 but, if the original is of A4 or smaller size, relay K3 will again energize clutch CL1 through a circuit of K4-2 - K3 - D8 - K8-2 -MS 4 D2 - MS13-A4, whereby a second sheet original of size A4 will begin to be transported during one rotation of the drum 17.

On the other hand, relay K6 is energized through a circuit of K8-2 - D7 - K6 - normally closed contacts of MS30, 61, and self-holds with the aid of K6-1 and K4-1.

Rotation of the photosensitive drum 17 causes cam 157 to actuate paper feed microswitches MS2 and MS5. Where the original is of size A3, microswitch MS2 will deenergize the normally energized solenoid SL2 and make a circuit of K6-2 - SL1, thereby controlling the paper feed rolls 46, $47_1$ of FIG. 1 to feed a sheet of transfer paper. Where the original is of A4 or smaller size, solenoids SL1 and SL2 will be changed over irrespective of the open or closed position of MS16-A4 - MS5, thus feeding two sheets of transfer paper for each one rotation of the drum 17.

In the illustrated circuitry, microswitches MS80, 81 are adapted to be actuated by the cam 159 of drum gear 77 so that their normally closed contacts may hold the relay E6 in ON state, and in addition, these switches serve to produce a jam detection signal.

Figure 17:
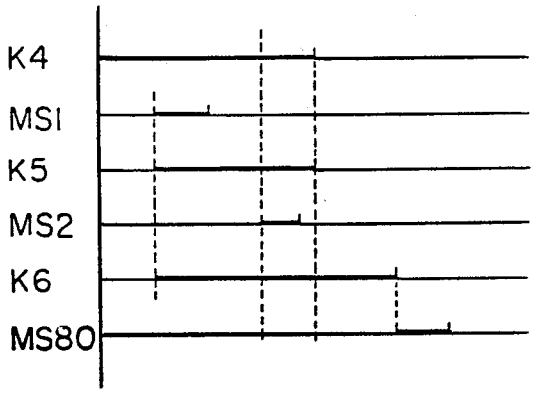
FIG. 17 is a time chart for the various switches in the same circuit.

When the interval between successive sheet originals is nearly equal to the spacing between rolls 18 and 21, it will be seen from the time chart of FIG. 17 that the contacts K4 and K5 are operative at a shorter interval than the microswitch MS2. Therefore, when the contact K4 (instead of K6) is used, the solenoid SL1 will not be energized even if a sheet original has properly passed the rolls 18 and 21, thus failing to effect paper feed. For this reason, use is made of relay K6 which may be operated for a predetermined time irrespective of the length of originals, with the aid of microswitches MS80, 81 provided on the drum 17 so as to be actuated later than the microswitch MS2.

II. Book Originals

When the original carriage 3 is displaced until the leading edge thereof reaches the detecting station (corresponding to the position assumed by photoelectric means 19, 20 during the sheet original copying operation), as described above, connectors 149, 150 will be disconnected and the position detector cam 151 on the underside of the original carriage will actuate microswitch MS14 to close its book original contact MS14-a.

When copy start button 14' is depressed, microswitch MS9 will be closed to make a circuit of MS14-a - MS9 - K8-1 - K1 - MS11-a3 - MS13-A3, through which the relay K1 will be energized and self-hold with the aid of its contact K1-1.

The cam 157 on the drum gear 77 will close the original start switch MS1 to make a circuit of K3-2NC - K1-2 - K2 - MS1, through which relay K2 for forwardly driving the original carriage will be energized and self-hold with the aid of its contact K2-1. Contact K2-3 will be closed to energize the solenoid SL3, so that the engagement between roll 63 and groove 66 will be released to unlock the carriage 3.

Closing of contact K2-2 will energize the clutch CL2 to move the carriage 3 forwardly. Cam 153 will actuate microswitch MS10 (for reversing the carriage movement in case of size A4) or microswitch MS11 (for reversing the carriage movement in case of size A3) which is located in the path of the carriage, whereby relay K1 and accordingly relay K2 will be deenergized to disengage clutch CL2, thus stopping the carriage 3.

The reversing contact of the microswitch MS10 or MS11 will energize relay K3 for reversely driving the original carriage, to thereby make a circuit of MS12 - K3 - MS10-A3 - D1 - MS13-A4 or MS12 - E3 - MS11-A4 - MS13-A3, and the relay K3 will self-hold with the aid of its contact K3-1. Through the contact K3-2 of this relay, the clutch CL3 will be energized to drive the carriage 3 in the opposite direction. When the carriage 3 returns to a predetermined position (i.e. when the leading edge $67_1$ of the carriage reaches the detecting position), cam 152 will actuate microswitch MS12 to open this switch and accordingly deenergize relay K4 and clutch CL3, thus stopping the carriage 3 at this position.

Start button 14' may be again depressed to repeat the above-described operation, or alternatively the apparatus will be automatically operated in response to counter means 14.

Thus, according to the present invention, the electrophotographic copying apparatus using the drum type image transfer system can be simply and readily changed over between the sheet original copying made and the book original copying mode without requiring the cumbersome detachment and reassemblage of the attachements. Moreover, the detection of the sheet original's position and the detection of the carriage's position during the book original copying mode take place at the same position and this enables the use of a common start signal from the photosensitive drum to simplify the control of the starting operation. During the sheet original copying mode, if the originals are of the size which permits two copies to be produced per full rotation of the photosensitive drum, the transportation of such originals and the feeding of copy or transfer sheets may take place in synchronism with each other to thereby enhance the efficiency of the copying operation.

Throughout the specification, the detection of the sheet original's position and the detection of the book original carriage's position have been described as taking place at the same position, but actually it is desirable that the stop position for the original carriage should be set to a position slightly more distant from the illuminating means 22 than the stop position for sheet originals, in view of the fact that the possible difference in inertia or the possible difference in the time required for stabilization of movement may occur between the sheet original and the original carriage when they are started to move by a common signal. Such an additional distance for the original carriage's stop position must be determined within a range which will in no way affect the start signal from the drum and the operation sequence of the various microswitches, and furthermore, the paper feed microswitches MS2 and MS5 must be used exclusively for the sheet original copying mode while additional two microswitches must be provided for use in the book original copying mode or alternatively, the copy paper feed signal just be produced in accordance with the movement of the original carriage.

We claim:

1. A copying apparatus comprising:

a rotatable photosensitive medium;

means for forming an image on said photosensitive medium, said image forming means including a reciprocable member for scanning an original to be copied through a slit as said reciprocable member moves along a predetermined path;

means for transferring the image onto transfer material;

means for feeding transfer material to said transferring means; and means for reciprocating said reciprocating member a preset number of times to obtain the preset number of copies, wherein said rotatable photosensitive medium completes at least two rotations for each reciprocation of said reciprocable member, said reciprocating means including advancing means for moving the reciprocable member in a first direction along said path for scanning operation during the first rotation of the photosensitive medium in response to switch means representing a position of said reciprocable member, and returning means for moving the reciprocable member in the opposite direction after completing the scanning operation to return the reciprocable member to a starting position during the last rotation of the photosensitive medium.

2. An apparatus according to claim 1, wherein said advancing means is actuated in accordance with the rotation of said photosensitive medium.

3. An apparatus according to claim 1, further comprising switching means for actuating said returning means, said switching means being disposed along the path of movement of said reciprocable member.

4. An apparatus according to claim 1, further comprising controlling means, associated with said transfer material feeding means, for feeding the transfer material so as to reach said transferring means during the first rotation of said photosensitive medium, and means for stopping the movement of said reciprocable member and the movement of said photosensitive medium after obtaining the preset number of copies.

5. An apparatus according to claim 1, wherein said reciprocable member is an original carriage for carrying the original thereon, the original carriage being movable through a distance corresponding to the length of a maximum original size to be copied plus the width of said slit.

6. An apparatus according to claim 1, wherein said transfer material feeding means includes feeding roller means, switching means responsive to the movement of said photosensitive medium for determining the timing of the feeding operation of said feeding roller means, and feeding roller control means responsive to said switching means for registering a leading edge of the transfer material with a leading edge of the image on said photosensitive medium.

7. An apparatus according to claim 1, further comprising control means for stopping the rotation of said photosensitive medium after the termination of a copy cycle, said control means being responsive to the rotational movement of said photosensitive medium.

8. An apparatus according to claim 1, wherein the image formed on said photosensitive medium is a latent image, and further comprising developing means for developing the latent image with a liquid developer and wherein said apparatus further comprises means for cleaning said photosensitive medium during rotation before the start of reciprocation of said reciprocable member for the first scanning operation.

9. An apparatus according to claim 8, further comprising means for supplying the liquid developer to said photosensitive medium before the first scanning operation.

10. An apparatus according to claim 1, further comprising means for selecting between a first mode wherein said rotatable medium rotates one time for one reciprocation of said reciprocable member and a second mode wherein said rotatable medium rotates at least two times for one reciprocation of said reciprocable member.

11. An apparatus according to claim 10, wherein said mode selecting means includes means for selecting a copy size, said apparatus further comprising means for controlling the stroke of the reciprocation of said reciprocable member in accordance with the size selected by said selecting means.

12. An apparatus according to claim 11, wherein said stroke controlling means includes a plurality of switches for actuating said returning means, said switches being disposed along the path of movement of said reciprocable member and being selectively enabled in accordance with the size selected by said selecting means.

13. An apparatus according to claim 1, wherein said image forming means includes an additional member for transporting the original during scanning to form an image and wherein said apparatus further comprises selecting means for selecting between a first mode wherein said rotatable medium rotates one time for one copy and a second mode wherein said rotatable medium rotates one time for a plurality of copies when said additional member is operated.

14. A copying apparatus operable in different modes comprising:

a rotatable photosensitive medium;

means for forming an image on said photosensitive medium, said image forming means including a reciprocable member for scanning an original to be copied through a slit as said reciprocable member moves along a predetermined path;

means for transferring the image onto transfer material;

means for feeding transfer material to said transferring means;

means for selecting a mode of operation of said copying apparatus;

means for reciprocating said reciprocable member a preset number of times to obtain the preset number of copies, said rotatable photosensitive medium rotating one time for one reciprocation of said reciprocable member when a first mode of operation is selected by said mode selecting means and at least two times for one reciprocation of said reciprocable member when a second mode of operation is selected by said mode selecting means, said reciprocating means including advancing means for moving the reciprocable member in a first direction along said path for a scanning operation during the first rotation in said first and second modes, and returning means for moving the reciprocable member in the opposite direction after completing the scanning operation to return the reciprocable member to a starting position during the first rotation in the first mode and during the last rotation in the second mode.

15. An apparatus according to claim 14, wherein said mode selecting means includes means for selecting a copy size and wherein said apparatus further comprises means for controlling the stroke of the reciprocation of said reciprocable member in accordance with the size selected by said selecting means.

16. An apparatus according to claim 15, wherein said stroke controlling means includes a plurality of switches for actuating said returning means, said switches being disposed along the path of movement of said reciprocable member and being selectively enabled in accordance with the size selected by said selecting means.

17. An apparatus according to claim 14, wherein said advancing means is actuated in accordance with the rotation of said photosensitive medium.

18. An apparatus according to claim 14, further comprising controlling means associated with said transfer material feeding means for feeding transfer material to reach said transferring means during the first rotation of said photosensitive medium, and means for stopping the movement of said reciprocable member and the movement of said photosensitive medium after obtaining the preset number of copies.

19. An apparatus according to claim 14, wherein said reciprocable member is an original carriage for carrying the original thereon, the original carriage being movable through a distance corresponding to the length of a maximum original size to be copied plus the width of said slit.

20. An apparatus according to claim 14, wherein said transfer material feeding means includes feeding roller means, switching means responsive to movement of said photosensitive medium for determining the timing of the feeding operation of said feeding roller means, and feeding roller control means responsive to said switching means for registering a leading edge of the transfer material with a leading edge of the image on said photosensitive medium.

21. An apparatus according to claim 14, further comprising control means for stopping the rotation of said photosensitive medium after the termination of a copy cycle, said control means being responsive to the rotational movement of said photosensitive medium.

22. An apparatus according to claim 14, wherein the image formed on said photosensitive medium is a latent image, and further comprising developing means for developing the latent image with a liquid developer and wherein said apparatus further comprises means for cleaning said photosensitive medium while being rotated before the start of reciprocation of said reciprocable member for the first scanning operation.

23. An apparatus according to claim 22, wherein said cleaning means includes a cleaning blade and wherein said apparatus further comprises means for supplying the liquid developer to said photosensitive medium before the first scanning operation.

24. A copying apparatus comprising:

a rotatable photosensitive drum;

means for forming an image of the original on a surface of the rotatable photosensitive drum, said image forming means including a reciprocable member for scanning an original to be copied;

means for feeding a transfer material;

means for transferring the image on the photosensitive drum onto the transfer material;

means for advancing and returning said reciprocable member to move away from and toward a starting position;

means for rotating said photosensitive drum through two revolutions for one copy; and control means for controlling said moving means to advance and return said reciprocable member for a period longer than that of one revolving movement of said photosensitive drum, wherein said reciprocable member is controlled to advance from its starting position during a first revolution of the drum, and return to its starting position after the beginning of the second revolution of the drum, and said control means enabling a second advancing movement of said reciprocable member in response to switch means representing a position of said reciprocable member, after said reciprocable member reaches the starting position and during a third revolution of said photosensitive drum under the condition of copy repeating instruction.

25. An apparatus according to claim 24, wherein the operation of said transfer material feeding means is in synchronism with said moving means.

* * * * *

UNITED STATES PATENT AND TRADEMARK OFFICE

CERTIFICATE OF CORRECTION

PATENT NO. : 4,270,857

DATED : June 2, 1981

INVENTOR(S) : Shigehiro Komori, et al.

It is certified that error appears in the above—identified patent and that said Letters Patent is hereby corrected as shown below:

Column 1, line 29, "is" should be --in--;
line 57, "hve" should be --have--.
Column 3, line 15, "as" should be --an--.
Column 5, line 66, "ovr" should be --over--.
Column 7, line 56, "4oll" should be --roll--.
Column 8, line 27, "80" should be --60--.
Column 9, line 29, "forward" should be --format--;
line 57, "tener" should be --toner--;
line 65, "turned" should be --tends--.
Column 10, line 43, "181 and 162" should be --MS81 and MS82--;
line 44, "M87" should be --MS7--;
line 45, "180" should be --160--;
line 47, after "to" insert --be--;

UNITED STATES PATENT AND TRADEMARK OFFICE

CERTIFICATE OF CORRECTION

PATENT NO. : 4,270,857

DATED : June 2, 1981

INVENTOR(S) : Shigehiro Komori, et al.

It is certified that error appears in the above—identified patent and that said Letters Patent is hereby corrected as shown below:

line 63, "synchro-pylley" should be --synchro-pulley--.

Column 11, line 7, "drum 105" should be --chain 103--;

line 39, "loading" should be --leading--.

Column 13, line 29, "to" (third occurrence) should be --of--.

Column 15, line 66, "has" should be --have--.

Column 16, line 45, "39" should be --89--.

Column 17, line 28, "measures" should be --assumes--;

lines 48 - 49, "actuating" should be --at a time--;

line 59, "the" should be --one--.

Column 18, line 34, "19" should be --K4--;

line 51, "153" should be --155--;

UNITED STATES PATENT AND TRADEMARK OFFICE

CERTIFICATE OF CORRECTION

PATENT NO. : 4,270,857

DATED : June 2, 1981

INVENTOR(S) : Shigehiro Komori, et al.

It is certified that error appears in the above—identified patent and that said Letters Patent is hereby corrected as shown below:

line 62, "K3" should be --K5--;

line 63, "K3" should be --K5--;

line 68, "MS30, 61" should be --MS80, 81--.

Column 19, line 15, "E6" should be --K6--;

line 64, "E3" should be --K3--.

Column 20, line 50, "just" should be --must--.

Signed and Sealed this

*Sixteenth* Day of *February 1982*

[SEAL]

*Attest:*

GERALD J. MOSSINGHOFF

*Attesting Officer*

*Commissioner of Patents and Trademarks*